US008393828B1

(12) United States Patent
Vidovic et al.

(10) Patent No.: US 8,393,828 B1
(45) Date of Patent: Mar. 12, 2013

(54) BORING MACHINE STEERING SYSTEM WITH FORCE MULTIPLIER

(75) Inventors: David A. Vidovic, West Salem, OH (US); Michael W. Thomas, Warsaw, OH (US)

(73) Assignee: American Augers, Inc., West Salem, OH (US)

( * ) Notice: Subject to any disclaimer, the term of this patent is extended or adjusted under 35 U.S.C. 154(b) by 355 days.

(21) Appl. No.: 12/800,667

(22) Filed: May 20, 2010

(51) Int. Cl.
*E21D 9/06* (2006.01)

(52) U.S. Cl. ..... 405/138; 405/143; 299/55; 175/61

(58) Field of Classification Search ..... 405/138, 405/141, 143, 184; 299/55; 175/61, 76
See application file for complete search history.

(56) References Cited

U.S. PATENT DOCUMENTS

| | | | | |
|---|---|---|---|---|
| 1,371,224 | A | | 3/1921 | Campbell |
| 1,403,530 | A | | 1/1922 | Whitaker et al. |
| 1,462,997 | A | | 7/1923 | Anderson |
| 1,478,466 | A | | 12/1923 | Anderson |
| 1,511,957 | A | | 10/1924 | Freda |
| 2,837,383 | A | | 6/1958 | Skelly |
| RE24,965 | E | | 4/1961 | Kirkpatrick |
| 2,988,348 | A | | 6/1961 | Robbins |
| 3,061,288 | A | | 10/1962 | Robbins |
| 3,139,148 | A | | 6/1964 | Robbins |
| 3,237,990 | A | | 3/1966 | Robbins |
| 3,290,098 | A | | 12/1966 | Scott |
| 3,321,148 | A | | 5/1967 | Williamson |
| 3,321,248 | A | | 5/1967 | Williamson et al. |
| 3,421,796 | A | | 1/1969 | Barrett |
| 3,467,437 | A | | 9/1969 | Bolotin |
| 3,517,966 | A | | 6/1970 | Montacie |
| 3,672,726 | A | | 6/1972 | House |
| 3,767,836 | A | * | 10/1973 | Geis et al. ..... 175/24 |
| 3,812,679 | A | | 5/1974 | Ruemmele |
| 3,865,196 | A | | 2/1975 | Winberg |
| 4,013,134 | A | | 3/1977 | Richmond |
| 4,142,763 | A | | 3/1979 | Kumaki |

(Continued)

FOREIGN PATENT DOCUMENTS

| | | | |
|---|---|---|---|
| JP | 08170489 | A | 7/1996 |
| WO | WO96/06264 | | 2/1996 |

OTHER PUBLICATIONS

Pipe Jacking, Microtunnelling, Tunnelling & Auger Boring; Trenchless Works; 2009 NoDig Media Services.

(Continued)

*Primary Examiner* — John Kreck
*Assistant Examiner* — Benjamin Fiorello
(74) *Attorney, Agent, or Firm* — Tomilson Rust McKinstry Grable

(57) ABSTRACT

A boring machine includes a steering head which is located behind a cutter head. The steering head has a plurality of steering openings spaced around its periphery. A steering component is mounted adjacent to each steering opening, and each steering component includes a steering paddle that is pivotally mounted with respect to the steering head so as to pivot about a paddle pivot axis. Each steering component also includes a linear actuator and a force multiplier. The linear actuator operates to direct an actuating force along a line that is parallel to the longitudinal axis of the steering head, and it cooperates with the force multiplier and the steering paddle so that upon operation of the linear actuator, a pivot force which is the product of the actuating force and a multiplier factor greater than one causes the steering paddle to pivot about the pivot axis.

20 Claims, 19 Drawing Sheets

U.S. PATENT DOCUMENTS

| | | | |
|---|---|---|---|
| 4,312,541 | A | 1/1982 | Spurgeon |
| 4,394,881 | A | 7/1983 | Shirley |
| 4,416,339 | A | 11/1983 | Baker |
| 4,456,305 | A | 6/1984 | Yoshikawa |
| 4,492,391 | A | 1/1985 | Haines |
| 4,527,837 | A | 7/1985 | Snyder |
| 4,589,502 | A | 5/1986 | Salter |
| 4,637,657 | A | 1/1987 | Snyder |
| 4,646,853 | A | 3/1987 | Sugden |
| 4,874,267 | A | 10/1989 | Ince |
| 4,936,709 | A | 6/1990 | Kimura |
| 5,046,783 | A | 9/1991 | Emanuelsson |
| 5,061,120 | A | 10/1991 | Akesaka |
| 5,099,927 | A | 3/1992 | Gibson |
| 5,125,768 | A | 6/1992 | Ilomaki |
| 5,284,403 | A | 2/1994 | Ilomaki |
| 5,295,734 | A | 3/1994 | Klomaki |
| 5,361,854 | A | 11/1994 | Tull et al. |
| 5,437,500 | A | 8/1995 | Lehmann |
| 5,470,132 | A | 11/1995 | Cartwright |
| 5,529,437 | A | 6/1996 | Filipowski et al. |
| 5,813,482 | A | 9/1998 | Barbera |
| 5,863,101 | A | 1/1999 | Seear |
| 5,890,771 | A | 4/1999 | Cass |
| 6,073,977 | A | 6/2000 | Schmidt-Hansen et al. |
| 6,142,577 | A | 11/2000 | Tayama |
| 6,206,109 | B1 | 3/2001 | Monier |
| 6,431,653 | B1 | 8/2002 | Kleuters |
| 6,688,408 | B2 | 2/2004 | Barbera |
| 7,048,050 | B2 | 5/2006 | Vail, III |
| 7,195,079 | B2 | 3/2007 | Self |
| 7,195,083 | B2 | 3/2007 | Eppink |
| 7,225,837 | B1 | 6/2007 | Kane |
| 7,320,485 | B2 | 1/2008 | Amendolea et al. |
| 7,510,025 | B2 | 3/2009 | Davies |
| 8,113,741 | B1 * | 2/2012 | Vidovic et al. ..... 405/184 |
| 2009/0078461 | A1 | 3/2009 | Mansure et al. |
| 2009/0152012 | A1 | 6/2009 | Salins |
| 2009/0297273 | A1 | 12/2009 | Lindbergh et al. |

OTHER PUBLICATIONS

Akkerman Marketing Brochure for Powered Reaming Head.

* cited by examiner

BORING MACHINE STEERING SYSTEM WITH FORCE MULTIPLIER

FIELD OF THE INVENTION

The invention relates generally to a tunnel boring machine. More particularly, the invention relates to such a machine which is adapted to install a plurality of differently-sized product casings in a bore. A guidance system allows an operator to guide the boring machine along a desired boring path without requiring the boring of an initial pilot hole. The invention comprises a steering system for such a machine which permits adjustment of the boring direction as boring commences.

BACKGROUND OF THE INVENTION

Subterranean boring machines are used to install a pipe comprised of multiple casing sections or a similar product in the ground without excavating a trench for the pipe. Some boring machines are used to bore a generally horizontal hole and to install a plurality of pipe sections therein between a generally vertical launch shaft or pit and a similarly oriented target shaft or pit. The launch shaft or pit is excavated to a depth to permit the boring machine to be placed in alignment and on grade with the desired underground installation. Boring machines that are commonly placed in such launch pits generally include a track that is located at the bottom of the launch pit and oriented along the desired boring direction, and a carriage that rolls or otherwise travels along the track. The carriage includes a pusher mechanism that is adapted to move the carriage along the track between a start point and a terminal point, and a rotational mechanism that is adapted to rotate a tool carried by the boring machine.

In some conventional boring machines, a pilot hole is first bored along the centerline of the intended product bore. Some such machines use a small pilot head having an inclined face at its leading end. Typically, the pilot system will include a hollow casing, and the pilot head will include an illuminated target on its trailing end. A theodolite mounted at a fixed position in the launch pit apart from the boring machine is aligned so that an operator can view the position of the illuminated target on the pilot head with respect to the cross-hairs of the theodolite. The first section of the pilot casing and the pilot head are pushed into the ground in the boring direction by the pusher mechanism without rotating the pilot head. However, because the inclined face on the pilot head gives rise to a reaction force exerted by the soil through which the head moves, rotation of the head as it is pushed in the boring direction may be required to keep the head on the desired course, as indicated by the position of the target with respect to the cross-hairs of the theodolite. When the carriage reaches the terminal point of the track, the pilot head is disengaged and the carriage is withdrawn to the start point. Multiple sections of pilot casing are added, one by one, to the end of the pilot string and pushed by the pusher mechanism until the pilot head reaches the target pit. After the pilot hole is completed, a boring assembly having an outer diameter that corresponds to the outer diameter of the product casing to be installed is selected. This boring assembly, which comprises a support casing with a cutter head at the leading end and an internal material removal auger or other conveyor located behind the cutter head, is lowered into the launch pit and mounted on the carriage. The boring assembly is attached to the rear end of the pilot casing and aligned with the pilot hole. As the carriage is then pushed or driven along the track following the pilot line, the cutter head is operated to bore a hole centered on the pilot bore, and the conveyor is operated to carry the cuttings back towards the launch pit. A plurality of spoil paddles located in a front section of the carriage sweep the cuttings out of the boring machine and into the launch pit through openings provided for that purpose. When the carriage reaches the terminal point of the track, the support casing and internal conveyor are disengaged and the carriage is retracted to the start point. The pilot head is removed from the pilot casing string in the target pit, and an additional section of support casing with an internal conveyor section is mounted to the carriage and attached to the casing and conveyor sections that were disengaged from the carriage. Then the carriage is engaged to drive the support casing further in the boring direction while operating the cutter head and the internal conveyor. Multiple sections of this cutting assembly are added, and the pilot system is removed, piece by piece, from the target pit, until the cutter head reaches the target pit. Then the support casing and conveyor sections are removed, one by one, as product pipe sections of the same outer diameter as the boring assembly are pushed by the carriage into the bore.

It is known to provide a steering system for conventional tunnel boring and drilling machines that include a cutter head, a plurality of support casings and an auger conveyor or other type of conveyor mounted within the support casings. Some such machines include hinge assemblies between the cutter head and the adjacent support casing, and a push rod or similar mechanism that extends along the top of the support casings. These machines are steered by tilting or pivoting the cutter head about one or more hinges to change the direction of the bore. Such machines are described in U.S. Pat. No. 4,013,134, U.S. Pat. No. 5,099,927 and U.S. Pat. No. 6,688,408. Other conventional machines include one or more hinge assemblies between the cutter head and the adjacent section of support casing, along with one or more axially aligned hydraulic actuators that can be employed to tilt or pivot the cutter head to change the direction of boring. Such machines are described in U.S. Pat. No. 5,061,120, U.S. Pat. No. 5,125,768 and U.S. Pat. No. 5,813,482.

The Bohrtec subsidiary of Herrenknecht sells a machine which may be used for small-diameter tunnels and does not require the formation of a pilot bore. The Bohrtec machine employs a boring assembly, carriage and track such as is employed by conventional machines that use a pilot bore, as well as a guidance system that allows for viewing an illuminated target mounted on the back side of the cutter head through the hollow shaft of an auger conveyor. The cutter head on the Bohrtec machine is mounted to a steering module that is selected to match the diameter of the product casing to be installed. The steering module is attached to a first support casing having a hollow internal auger in such a way that the operator can tilt the steering module with respect to the first support casing (as in conventional tilt steering systems), thereby steering by ground reaction forces as the support casing, steering module and cutter head are pushed by the carriage into the ground along the desired bore path. Cuttings cut by the cutter head are carried by the internal auger through the support casing back to the launch pit. When the carriage reaches the terminal point of the track, the support casing and internal conveyor are disengaged and the carriage is retracted to the start point. An additional section of support casing with an internal auger conveyor section is mounted to the carriage and attached to the support casing and conveyor sections that were disengaged from the carriage. Then the carriage is engaged to drive the steering module and support casing further in the boring direction while operating the cutter head and the internal conveyor. Multiple sections of this cutting assembly are added until the steering module reaches the target pit. Then the support casing and conveyor sections are removed, one by one, as product pipe sections of the same outer diameter are pushed by the carriage into the bore.

International Patent Publication No. WO 96/06264 describes a steering system for an auger boring machine which includes a pair of "wedge-shaped moveable parts" that are located 180° apart on the drilling head. Each wedge-shaped part bears against and supports an annular housing for roller bearings and also bears against the inner surface of a forward pipe section. An axially-oriented actuating cylinder is pivotally attached to both the forward pipe section and one of the wedge-shaped parts. An interconnecting arm connects the wedge-shaped parts and is articulated at opposing points 90° away from the wedge-shaped parts so that if one of the parts is pushed forward by the cylinder, the oppositely located part will move backward by the same amount. This allows the actuation of the cylinder to move the annular housing eccentrically with respect to the forward pipe section.

U.S. Pat. No. 5,863,101 describes a mining machine which includes a cutting assembly having cutting heads that are supported by and steerable with respect to a housing. The cutting assembly includes first steering surfaces which guide the cutting assembly in a vertical plane and second steering surfaces, located on opposite sides of the housing, which provide lateral control. The steering surfaces are controlled by actuators acting on toggle mechanisms, which in turn act on links that extend to the associated steering members.

Notes on Construction

The use of the terms "a", "an", "the" and similar terms in the context of describing the invention are to be construed to cover both the singular and the plural, unless otherwise indicated herein or clearly contradicted by context. The terms "comprising", "having", "including" and "containing" are to be construed as open-ended terms (i.e., meaning "including, but not limited to,") unless otherwise noted. The terms "substantially", "generally" and other words of degree are relative modifiers intended to indicate permissible variation from the characteristic so modified. The use of such terms in describing a physical or functional characteristic of the invention is not intended to limit such characteristic to the absolute value which the term modifies, but rather to provide an approximation of the value of such physical or functional characteristic. All methods described herein can be performed in any suitable order unless otherwise specified herein or clearly indicated by context.

The use of any and all examples or exemplary language (e.g., "such as") herein is intended merely to better illuminate the invention and not to place a limitation on the scope of the invention, unless otherwise indicated by the claims. Nothing in the specification should be construed as indicating any non-claimed element as essential to the practice of the invention.

Various terms are specifically defined herein. These terms are to be given their broadest possible construction consistent with such definitions, as follows:

The term "boring direction", when used in describing the operation of a boring machine or the relative position of a component of a boring machine, refers to the direction of advance of the cutter head of the machine as the boring operation is carried out.

The terms "front" and "front end" of the boring machine refer to the end of the machine that leads in the boring direction. When referring to a component of the boring machine, the terms "front" and "front end" refer to that portion of the component that is nearer the front end of the boring machine.

The terms "rear" and "rear end" of the boring machine refer to the end opposite the front end. When referring to a component of the boring machine, the terms "rear" and "rear end" refer to that portion of the component that is nearer the rear end of the boring machine.

The terms "forward" and "in front or", as used herein to describe a relative position or direction on or in connection with a boring machine, refer to a relative position towards the front end of the machine or towards the boring direction.

The terms "rearward", "behind" and "rearwardly", as used herein to describe a relative position or direction on or in connection with a boring machine, refer to a relative position or direction towards the rear end of the machine or opposite the boring direction.

The term "linear actuator" refers to an electric, hydraulic or electro-hydraulic device that generates force which is directed in a straight line. One common example of a "linear actuator" is a hydraulic actuator which includes a cylinder, a piston within the cylinder, and a rod attached to the piston. By increasing the pressure within the cylinder on one side of the piston (over that on the opposite side of the piston), the rod will extend from the cylinder or retract into the cylinder.

The terms "product casing", "product casing component", "product casing section" and similar terms refer to a section of pipe or other product that is installed or intended to be installed in a bore. The term "product casing" may also refer to a plurality of sections of pipe or other product or product casing components that are joined, or intended to be joined, together. The term "differently-sized product casings" refers to product casings having different inside diameters and/or outside diameters. The terms "a selected one of the product casings", "selected product casings" and similar terms refer to a product casing having an inside diameter that is selected for installation within a particular bore. The term "corresponds" and similar terms, when used to compare a diameter or other dimension of a component of the auger boring machine with a similar dimension of "a selected one of the product casings", refers to the suitability of the component having such dimension for use in installing the "selected one of the product casings".

The terms "internal casing", "internal casing component", "internal casing section" and similar terms refer to a section of the portion of the boring machine that is adapted to include an auger section which is adapted to rotate with respect to the internal casing. The term "internal casing" may also refer to a plurality of sections of internal casing or internal casing components that are joined, or intended to be joined, together.

SUMMARY OF THE INVENTION

The invention comprises a boring machine with a cutter head and a steering head that is located behind a cutter head. The steering head has a plurality of steering openings spaced around its periphery. A steering component is mounted adjacent to each steering opening within the steering head. Each steering component includes a steering paddle that is pivotally mounted with respect to the steering head so as to pivot about a paddle pivot axis. Each steering component also includes a linear actuator and a force multiplier. The linear actuator operates to direct an actuating force along a line that is parallel to the longitudinal axis of the steering head, and the force multiplier is arranged and configured with respect to the steering paddle and the linear actuator so that upon operation of the linear actuator, a pivot force causes the steering paddle to pivot about the pivot axis. The pivot force is the product of the actuating force and a multiplier factor greater than one.

The boring machine is adapted to install a plurality of differently-sized product casings in a bore. This boring machine includes an internal casing having an outside diameter which is less than the inside diameter of all of the differently-sized product casings that can be installed using the machine. The internal casing is adapted to be placed within a selected one of the product casings with its longitudinal axis coincident with the longitudinal axis of the selected product casing, thereby forming an annular space with respect to the selected product casing. An adjustable support assembly is adapted to be located between the outside surface of the internal casing and the inside surface of the selected product casing for maintaining the coincidence of the internal casing longitudinal axis with the product casing longitudinal axis, and an auger is located within the internal casing and adapted to rotate with respect thereto. The preferred boring machine includes a rotational mechanism that is operationally connected to the auger, so that as the auger is rotated, material within the internal casing will be conveyed towards the rear end of the auger. A pusher mechanism is provided to advance the product casing, internal casing and auger along the boring direction. The preferred boring machine also includes a plurality of cutter heads and steering heads, each of which is sized to correspond to one of the selected product casings which may be installed. Each cutter head is adapted to be attached to the front end of the auger, and each steering head is adapted to be located behind a selected one of the cutter heads and adapted to receive the front end of the internal casing. Each steering head has a plurality of steering openings spaced around its periphery, and a steering component mounted adjacent to each steering opening within the steering head.

In order to facilitate an understanding of the invention, the preferred embodiments of the invention, as well as the best mode known by the inventors for carrying out the invention, are illustrated in the drawings, and a detailed description thereof follows. It is not intended, however, that the invention be limited to the particular embodiments described or to use in connection with the apparatus illustrated herein. Therefore, the scope of the invention contemplated by the inventors includes all equivalents of the subject matter recited in the claims, as well as various modifications and alternative embodiments such as would ordinarily occur to one skilled in the art to which the invention relates. The inventors expect skilled artisans to employ such variations as seem to them appropriate, including the practice of the invention otherwise than as specifically described herein. In addition, any combination of the elements and components of the invention described herein in any possible variation is encompassed by the invention, unless otherwise indicated herein or clearly excluded by context.

BRIEF DESCRIPTION OF THE DRAWINGS

The presently preferred embodiments of the invention are illustrated in the accompanying drawings, in which:

FIG. 3 also shows a first-sized cutting head and product casing in solid lines, and the outline for a second-sized cutting head and product casing in broken lines.

DESCRIPTION OF THE PREFERRED EMBODIMENTS OF THE INVENTION

Figure 1:
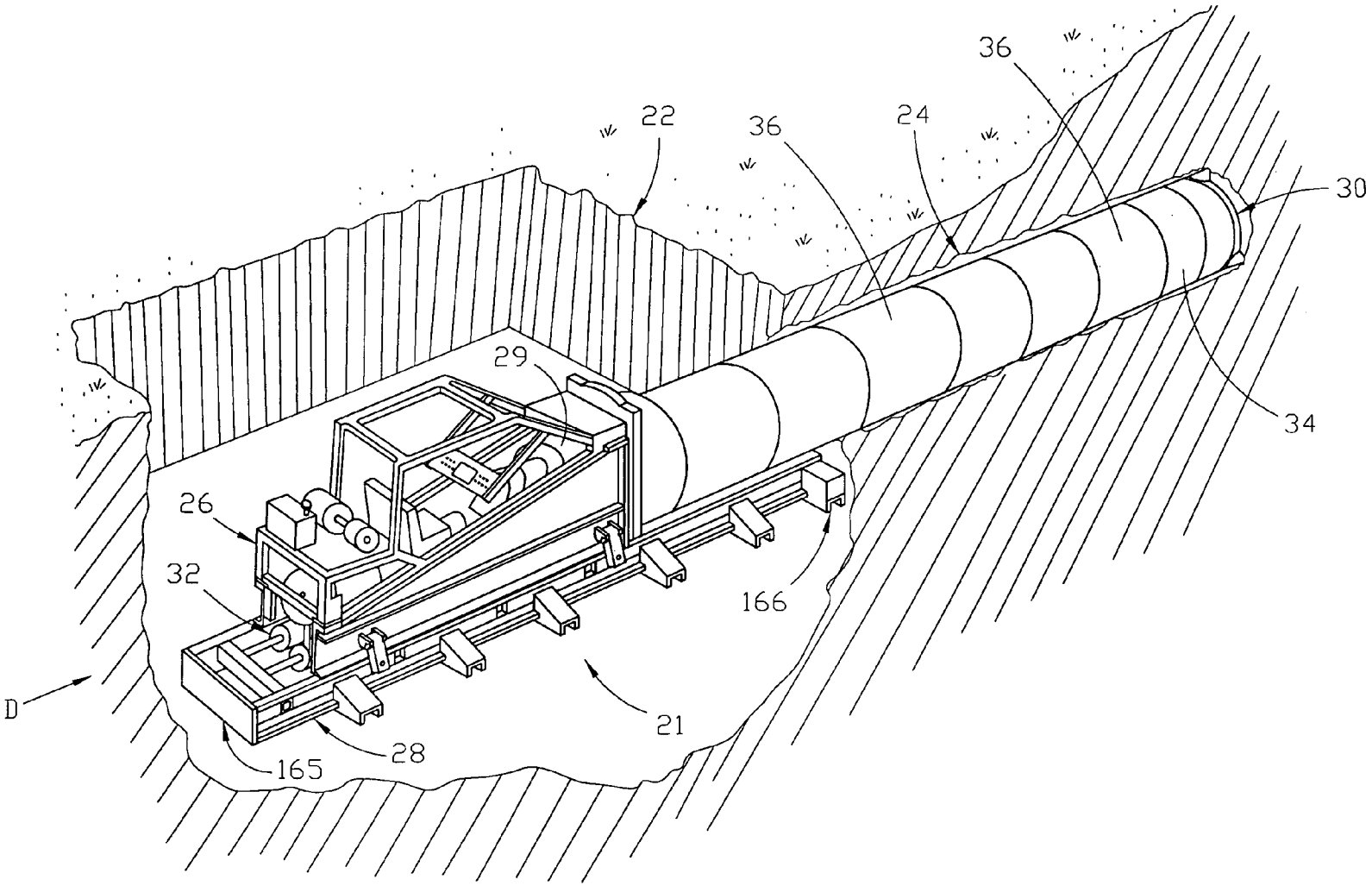
FIG. 1 is a perspective view of a boring machine constructed according to a preferred embodiment of the invention, showing the machine in a launch pit with the boring operation having been commenced.

Referring now to FIG. 1, boring machine 21, comprising a preferred embodiment of the invention, is located in launch pit 22 and is shown as it would appear in the process of boring tunnel 24. Boring machine 21 includes carriage 26 which is mounted on and adapted to move along track 28 in boring direction D. The carriage includes conventional rotational mechanism 29 for operating a selected one of a plurality of cutter heads, such as cutter head 30, and conventional pusher mechanism 32 for pushing or driving the carriage along the track.

Boring machine 21 also includes a plurality of steering heads, including steering head 34, and is intended for use in installing a plurality of product casings of various sizes, including product casing 36 (shown in solid lines in various drawings) and alternative product casing 38 (shown in dashed lines in FIG. 3), in a bore. Each product casing of a particular size, such as product casing 36, that is installed in a bore is comprised of a number of product casing components that are joined together end to end. Each cutter head and steering head is selected to correspond to the diameter of the tunnel to be bored and to the diameter of the selected product casing to be installed. Preferably, the steering head is welded to the front end of the first product casing section and the cutter head is welded to the front end of the steering head.

Figure 3:
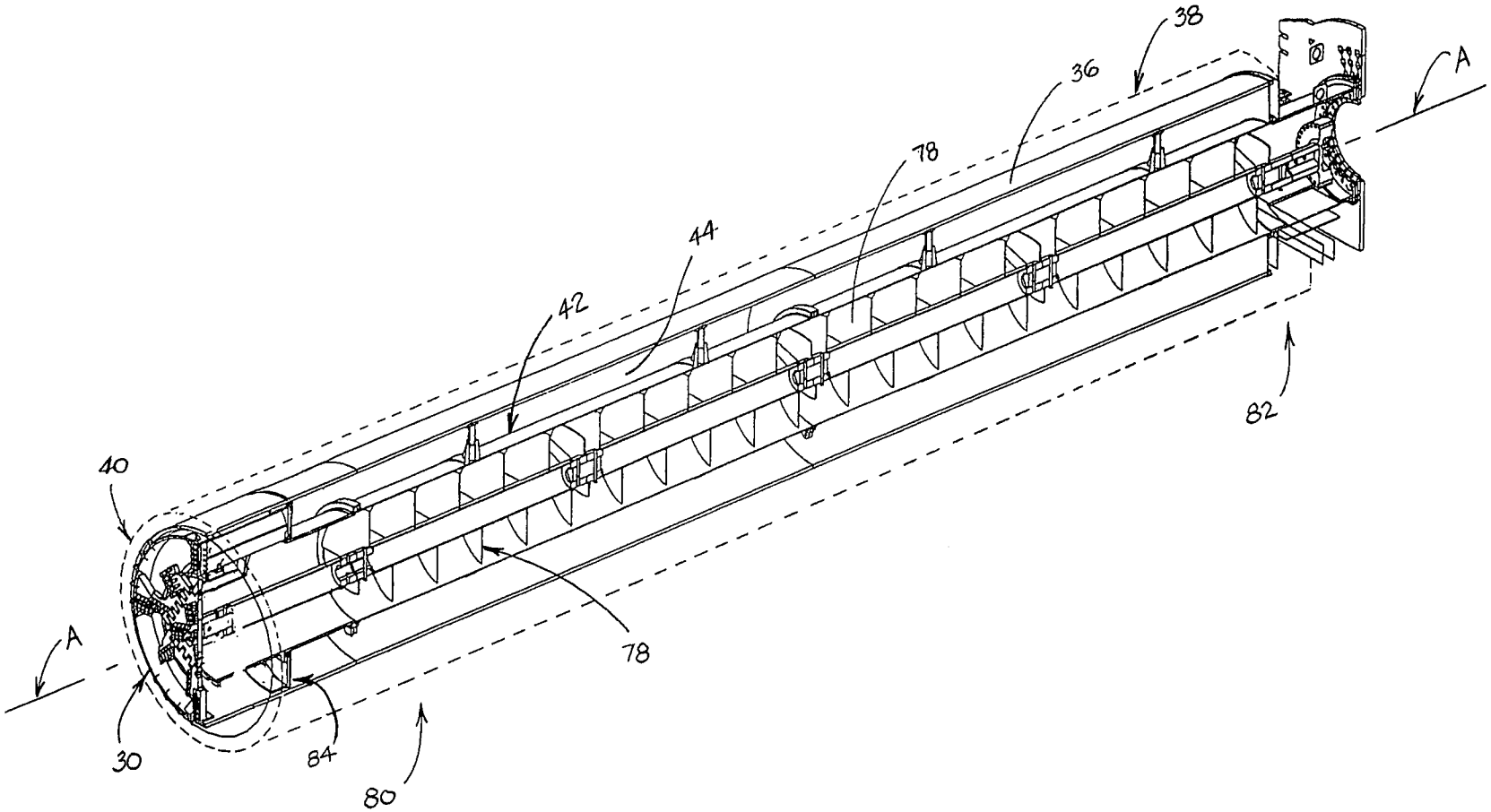
FIG. 3 is a sectional view of a portion of the boring machine of FIG. 2, taken along the line 3-3 of FIG. 2, but modified to show a portion of the cutter head and an intact product casing.

FIG. 3 also shows (in broken lines) alternative cutter head 40, along with cutter head 30. Thus, the preferred boring machine includes a plurality of sets of cutter heads and steering heads for use in connection with a plurality of differently-sized product casings. The outside diameter of the cutter head and steering head in each set corresponds to the outside diameter of the selected product casing to be installed. Each of the product casings has a product casing longitudinal axis A (shown in FIG. 3), a product casing outside diameter such as outside diameter $OD_{36}$ of product casing 36 (shown in FIG. 4), a product casing inside diameter such as product casing inside diameter $ID_{36}$ of product casing 36, and a product casing inside surface, such as product casing inside surface $S_{36}$ of product casing 36.

Figure 2:
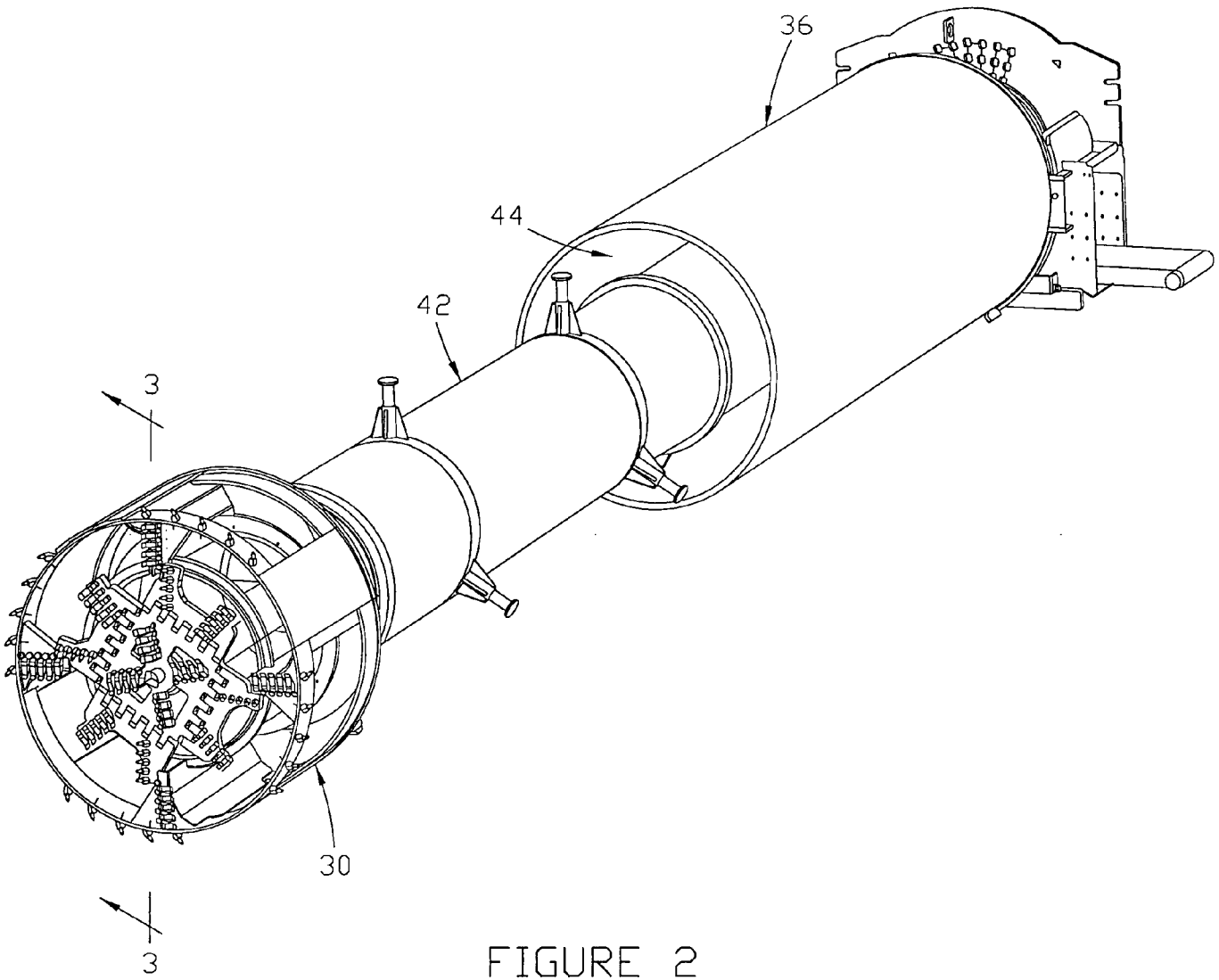
FIG. 2 is a partial perspective view of the boring machine of FIG. 1, showing a cutter head, a portion of a product casing, an internal casing and an adjustable support assembly.

The boring machine also includes internal casing 42 (not shown in FIG. 1) having an outside diameter $OD_{42}$ which is less than the inside diameter of all of the product casings that can be installed using the machine. Preferably, internal casing outside diameter $OD_{42}$ is no more than about 60% of the product casing inside diameter of the product casing having the smallest product casing inside diameter that can be installed using the machine. Internal casing 42 is adapted to be placed within a selected one of the product casings with its internal casing longitudinal axis coincident with longitudinal axis A of the selected product casing, so that, regardless of which product casing size is selected, an annular space, such as space 44 shown in FIGS. 2-4, will be formed between outside surface $S_{42}$ of internal casing 42 and the inner surface of the product casing. Hydraulic lines, cables and wiring for the cutter head and steering head (not shown in the drawings) are placed within this annular space and protected from contact with the tunnel walls and from contact with material cut by the cutter head as boring is carried out. Furthermore, a laser guidance system for the steering assembly (not shown in the drawings) may be operated within the annular space, where it will also be protected.

Figure 4:
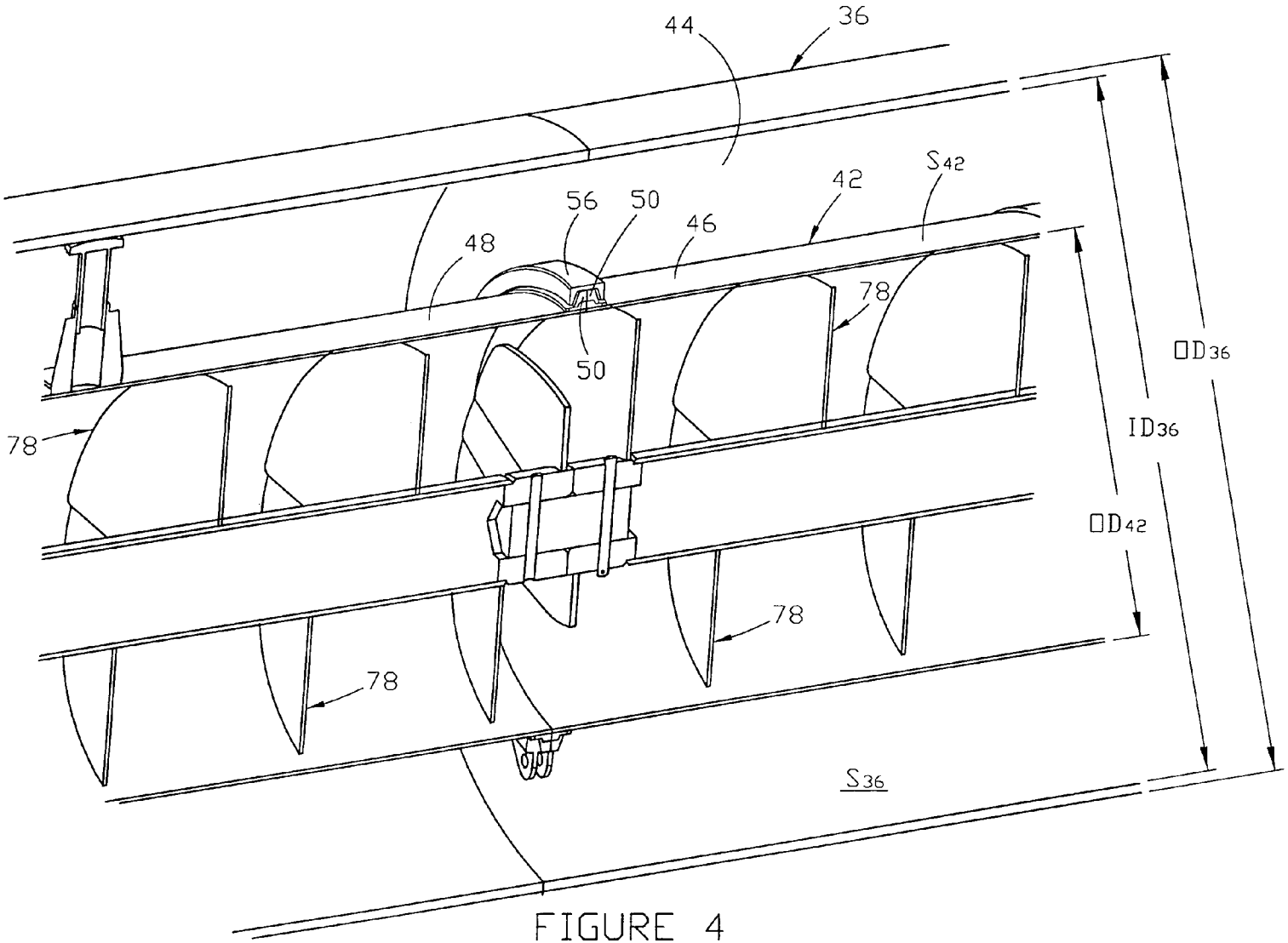
FIG. 4 is a detailed view of a portion of the boring machine of FIG. 3, showing an internal casing joint between a pair of internal casing components of a preferred embodiment of the invention.
Figure 6:
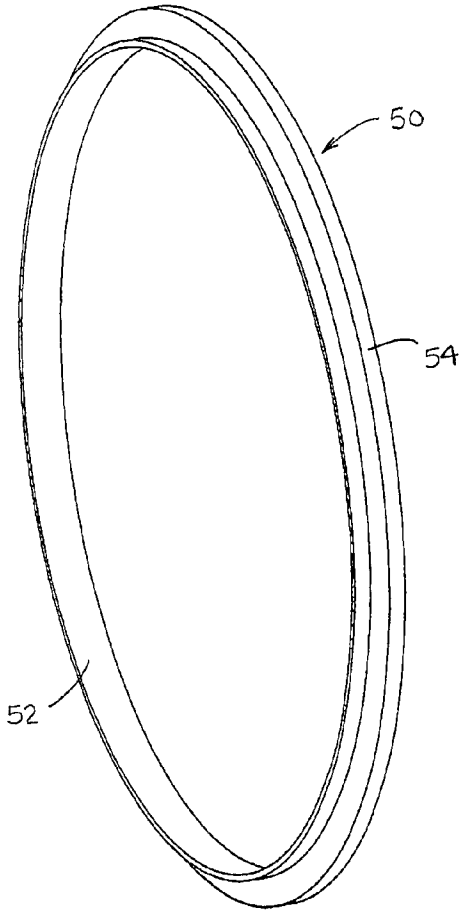
FIG. 6 is a perspective view of the end flange of FIG. 5.
Figure 5:
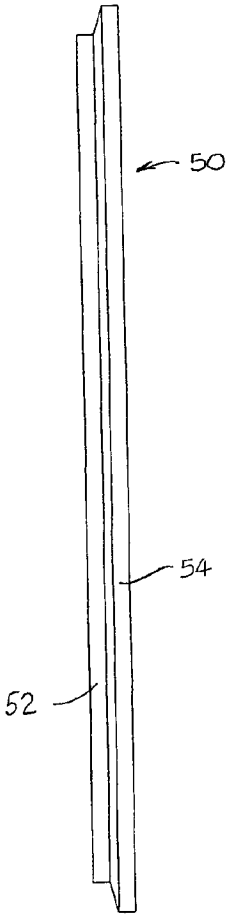
FIG. 5 is a side view of an end flange of a preferred embodiment of the invention.
Figure 7:
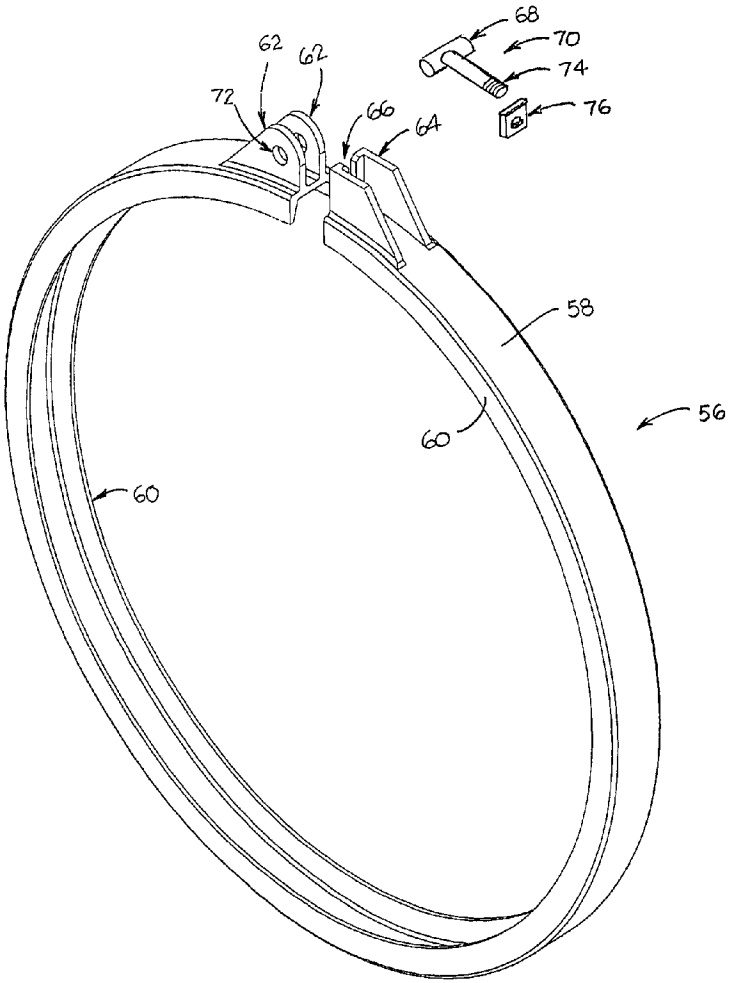
FIG. 7 is a perspective view of a clamp of a preferred embodiment of the invention.

Preferably, the internal casing comprises a plurality of internal casing components that are joined together end to end at a plurality of internal casing joints. As best shown in FIG. 4, internal casing 42 comprises a plurality of internal casing components, including internal casing components 46 and 48. Components 46 and 48 are joined together at an internal casing joint comprising end flanges 50 mounted to adjacent ends of adjacent internal casing components 46 and 48. As best shown in FIGS. 4-7, each end flange includes band portion 52 that is welded or otherwise secured to the outside surface of internal casing 42, and upstanding rim 54 that is adapted to be engaged by clamp 56. More particularly, each clamp 56 is adapted to encircle and engage the end flanges of adjacent internal casing components. As shown in FIG. 7, preferred clamp 56 is a band 58 having a pair of flange engagement sides 60 and a pair of ends that can be drawn together. One end includes a pair of spaced eyes 62 and the other includes engagement bracket 64 with engagement slot 66. T-shaped head 68 of bolt 70 is adapted to be received in holes 72 in spaced eyes 62, and threaded end 74 of bolt 70 extends into engagement slot 66. Nut 76 threads onto threaded end 74 of the bolt and is retained within engagement bracket 64.

The preferred boring machine also a material conveyor such as auger 78 that is located within the internal casing. Auger 78 has front end 80 and rear end 82, and conventional rotational mechanism 29 is operationally connected to the auger. The auger is adapted to rotate with respect to internal casing 42, so that operation of the rotational mechanism will cause the auger to convey material within the internal casing towards rear end 82 of the auger. Simultaneously with rotation of the auger, pusher mechanism 32 advances the cutter head, steering head, auger, product casing and internal casing along boring direction D.

The boring machine includes a plurality of front bulkheads, such as front bulkhead 84 (shown in FIGS. 3 and 8), each of which is adapted to be located around the internal casing behind the selected cutter head and in front of the adjacent steering head. One function of the front bulkhead is to insure that material cut by the cutter head does not get into annular space 44 between outside surface $S_{42}$ of internal casing 42 and the inner surface of the steering head or the product casing. The preferred boring machine also includes means for directing material cut by the selected cutter head into the internal casing so that rotation of the auger will convey such material towards the rear end of the auger within the internal casing.

Figure 8:
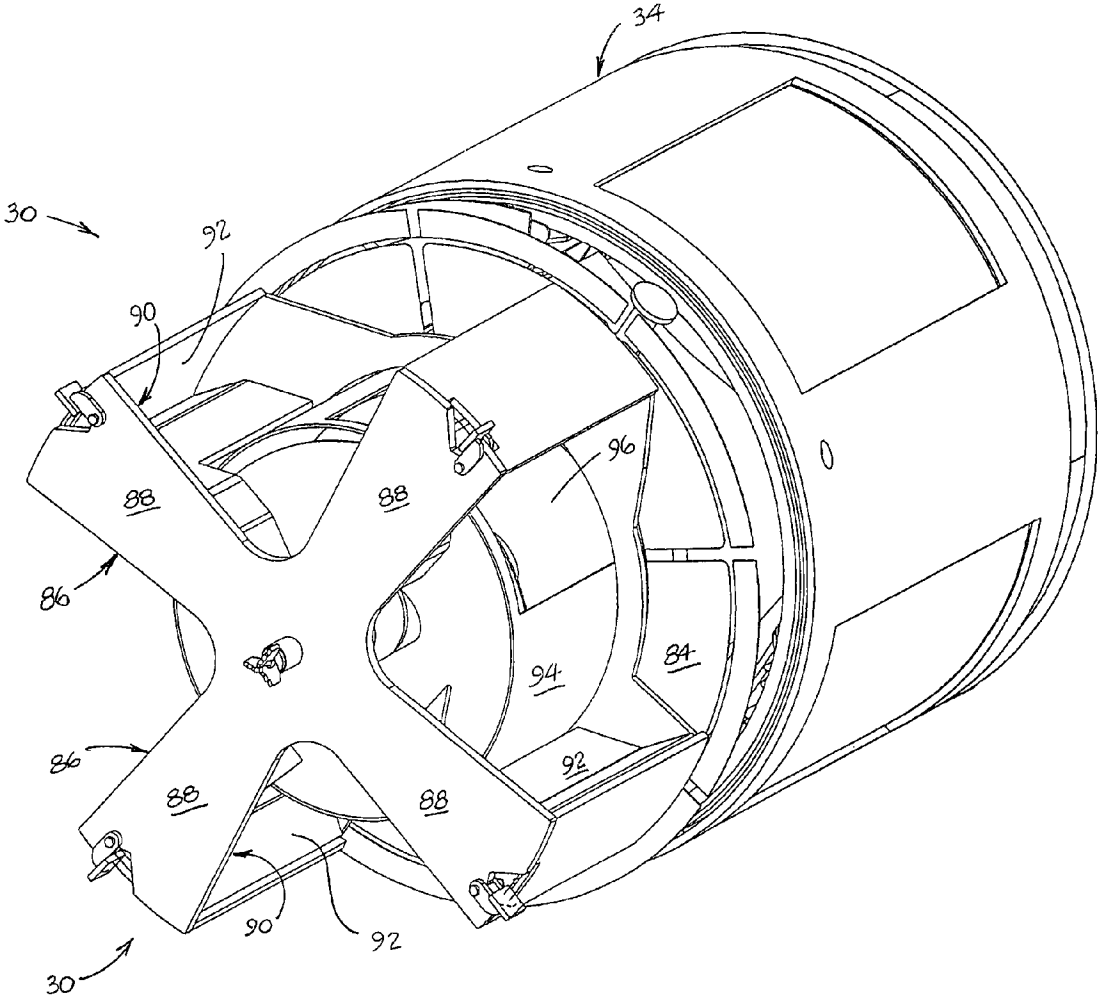
FIG. 8 is a perspective view of a portion of the boring machine of FIG. 2, showing the details of a cutter head assembly and a portion of a steering head of a preferred embodiment of the invention.
Figure 9:
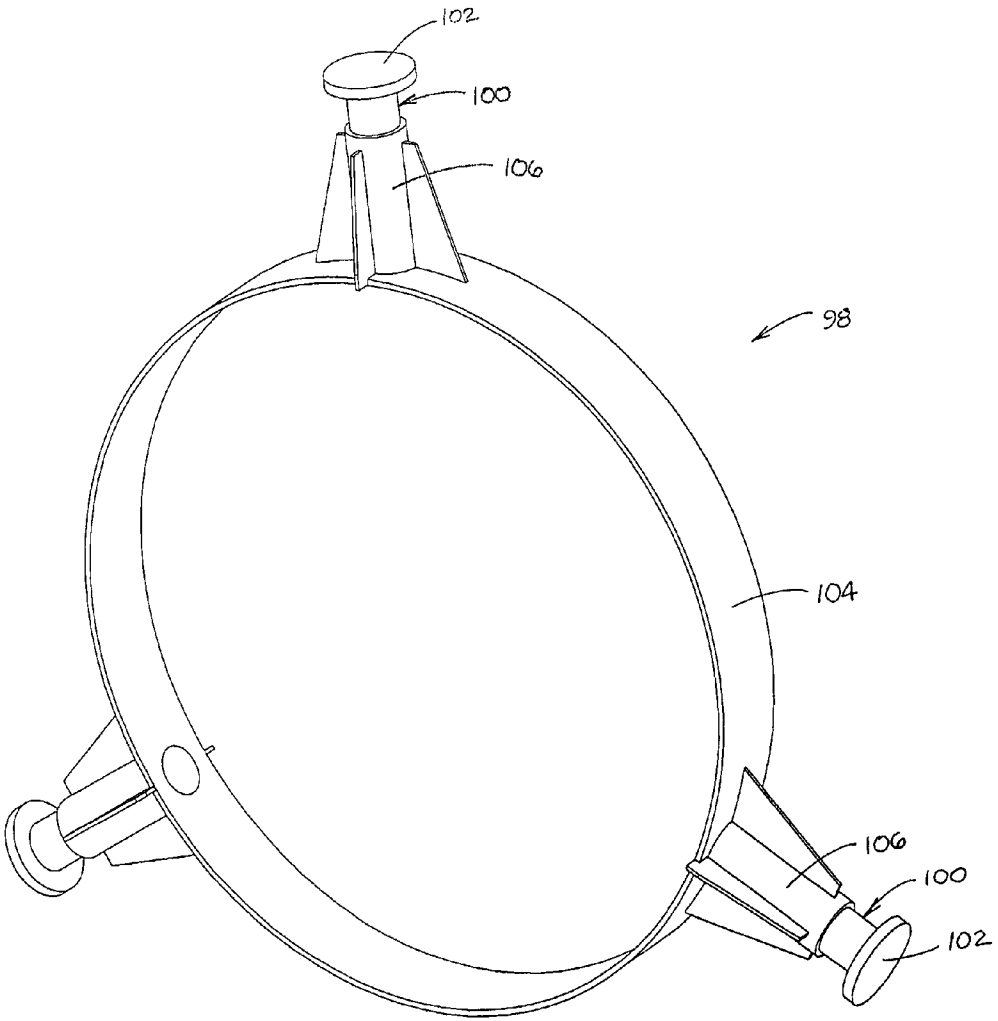
FIG. 9 is a perspective view of an adjustable support assembly of a preferred embodiment of the invention.
Figure 10:
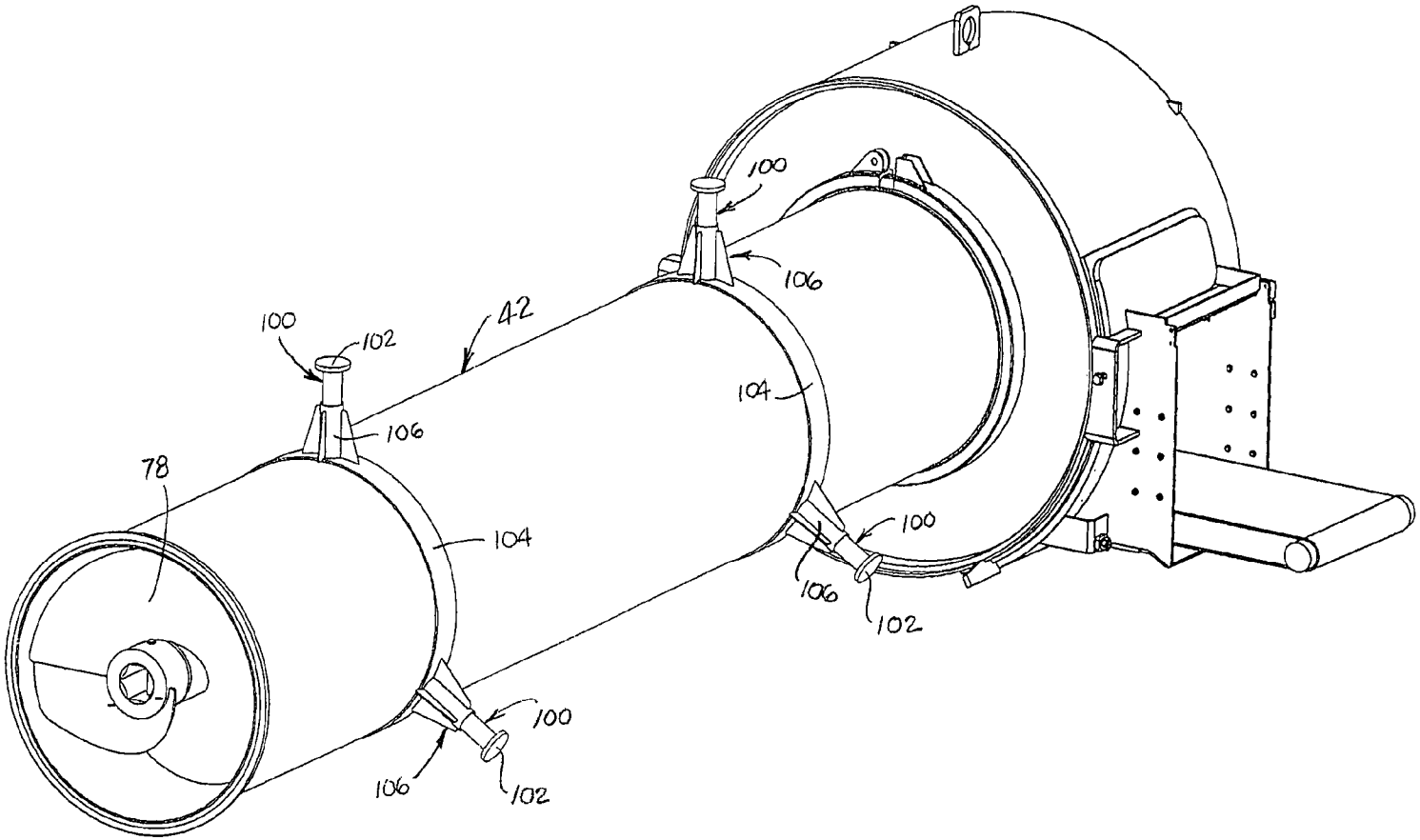
FIG. 10 is a partial perspective view of a portion of the boring machine of FIG. 2, with the cutter head, steering head and product casing removed.

As best shown in FIG. 8, cutter head 30 includes a plurality of cutter blades 86, each of which has front side 88 and rear side 90. The cutter blades are operationally attached to the auger, either directly or through a linkage mechanism, so that rotation of the auger will also rotate the cutter blades. In this embodiment of the invention, the means for directing material cut by the cutter blades of the selected cutter head into the internal casing comprises a plurality of collecting buckets 92, each of which is mounted on the rear side of a cutter blade. These collecting buckets sweep material cut by the cutter blades into hopper 94 through hopper opening 96 as the cutter blades rotate. Hopper 94 is an extension of internal casing 42 and includes front end 80 of auger 78.

The preferred boring machine also includes an adjustable support assembly that is adapted to be located between outside surface $S_{42}$ of internal casing 42 and the inside surface of the selected product casing (and, optionally, the corresponding steering head) for maintaining the coincidence of the internal casing longitudinal axis with the product casing longitudinal axis. Preferred adjustable support assembly 98 comprises a plurality of internal casing support legs 100 that are spaced around the periphery of the internal casing and along its length. Each support leg 100 includes a bearing pad 102 that is adapted to bear against the inside surface of the selected product casing (or steering head), such as against product casing inside surface $S_{36}$ of product casing 36. Adjustable support assembly 98 also includes internal support band 104 that is disposed around the periphery of the internal casing and welded or otherwise affixed thereto. Adjustable support assembly 98 also includes a plurality of leg supports 106, each of which is adapted to cooperate with an internal casing support leg 100 in the preferred adjustable support assembly. Preferably, each of internal casing support legs 100 is provided with external threads and each cooperating leg support 106 is provided with corresponding internal threads, so that the length of the portion of each support leg 100 that extends from its corresponding leg support 106 can be adjusted, by threading the support leg into or out of the leg support, depending on the inside diameter of the product casing, such as product casing inside diameter $ID_{36}$ of product casing 36.

Figure 11:
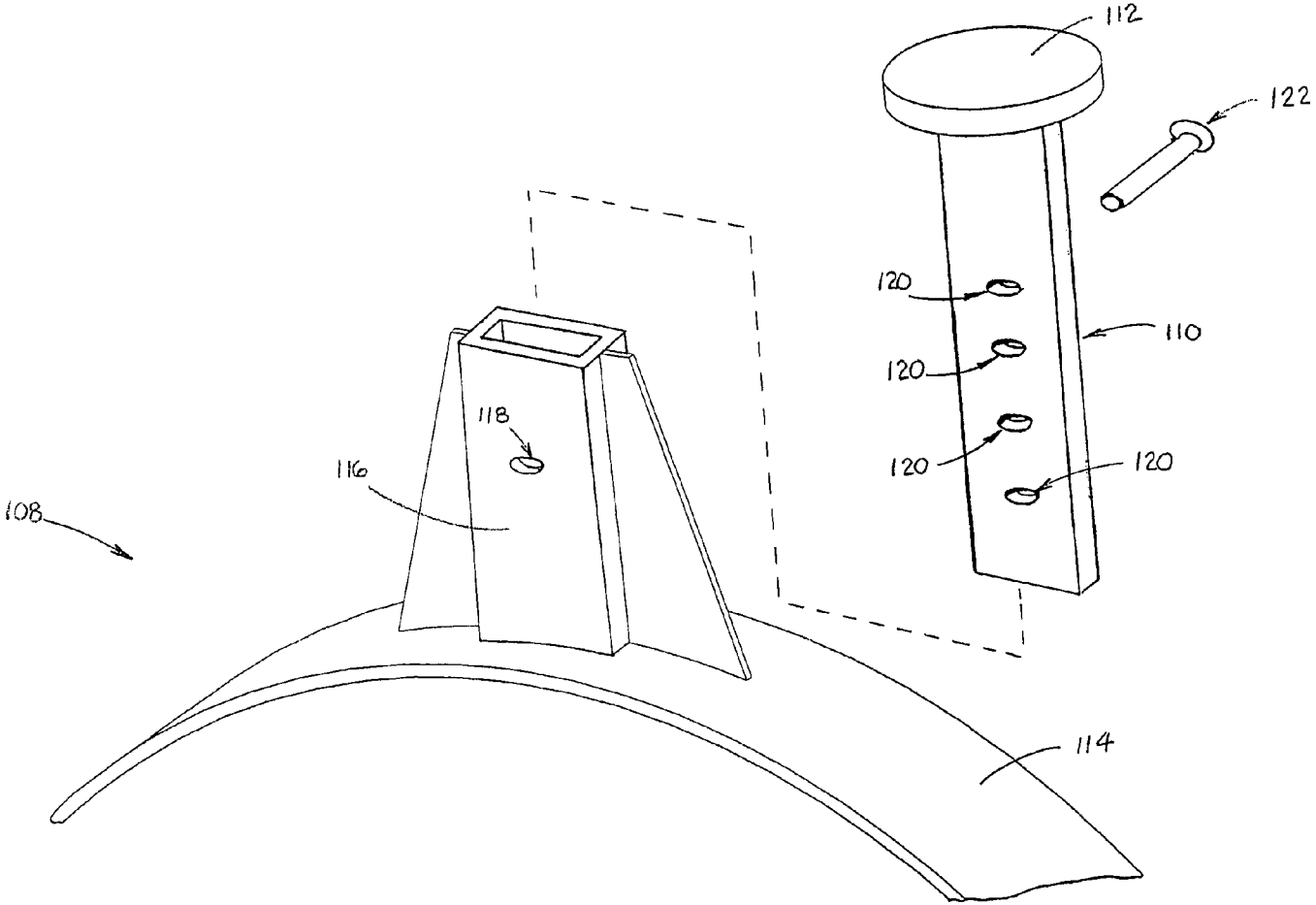
FIG. 11 is a partial perspective view of an alternative internal casing support leg and leg support of an adjustable support assembly.

In another embodiment of the adjustable support assembly, each internal casing support leg is in adjustable telescoping relationship with an associated leg support so that the length of the corresponding support assembly may be varied. Each adjustable support assembly 108 of this embodiment, like that of adjustable support assembly 98, comprises a plurality of internal casing support legs that are spaced around the periphery of the internal casing and along its length. As shown in FIG. 11, each support leg 110 of this embodiment includes a bearing pad 112 that is adapted to bear against the inside surface of the selected product casing (or the corresponding steering head), such as against product casing inside surface $S_{36}$ of product casing 36. Adjustable support assembly 108 also includes internal support band 114 that is disposed around the periphery of the internal casing and welded or otherwise affixed thereto. Adjustable support assembly 108 also includes a plurality of leg supports 116, each of which is adapted to cooperate with an internal casing support leg 110 to comprise a support assembly. In this embodiment of the invention, leg support 116 is provided with adjustment hole 118, and support leg 110 is provided with a plurality of adjustment holes 120, so that support leg 110 may be telescoped within leg support 116 between a plurality of positions, each of which aligns an adjustment hole 120 with adjustment hole 118 so that attachment pin 122 may be placed through the holes to secure the support leg to the leg support. Of course, it is also contemplated within the scope of the invention that the internal casing support leg may be provided with a single adjustment hole (not shown) and the associated leg support provided with a plurality of adjustment holes (also not shown), each of which is adapted to receive the attachment pin. In either configuration of this embodiment of the invention, the internal casing support leg and associated leg support are arranged and configured so that the adjustment holes on each component may be aligned in a plurality of configurations, each of which corresponds to a support assembly length that is determined by the inside diameter of the selected product casing.

Figure 12:
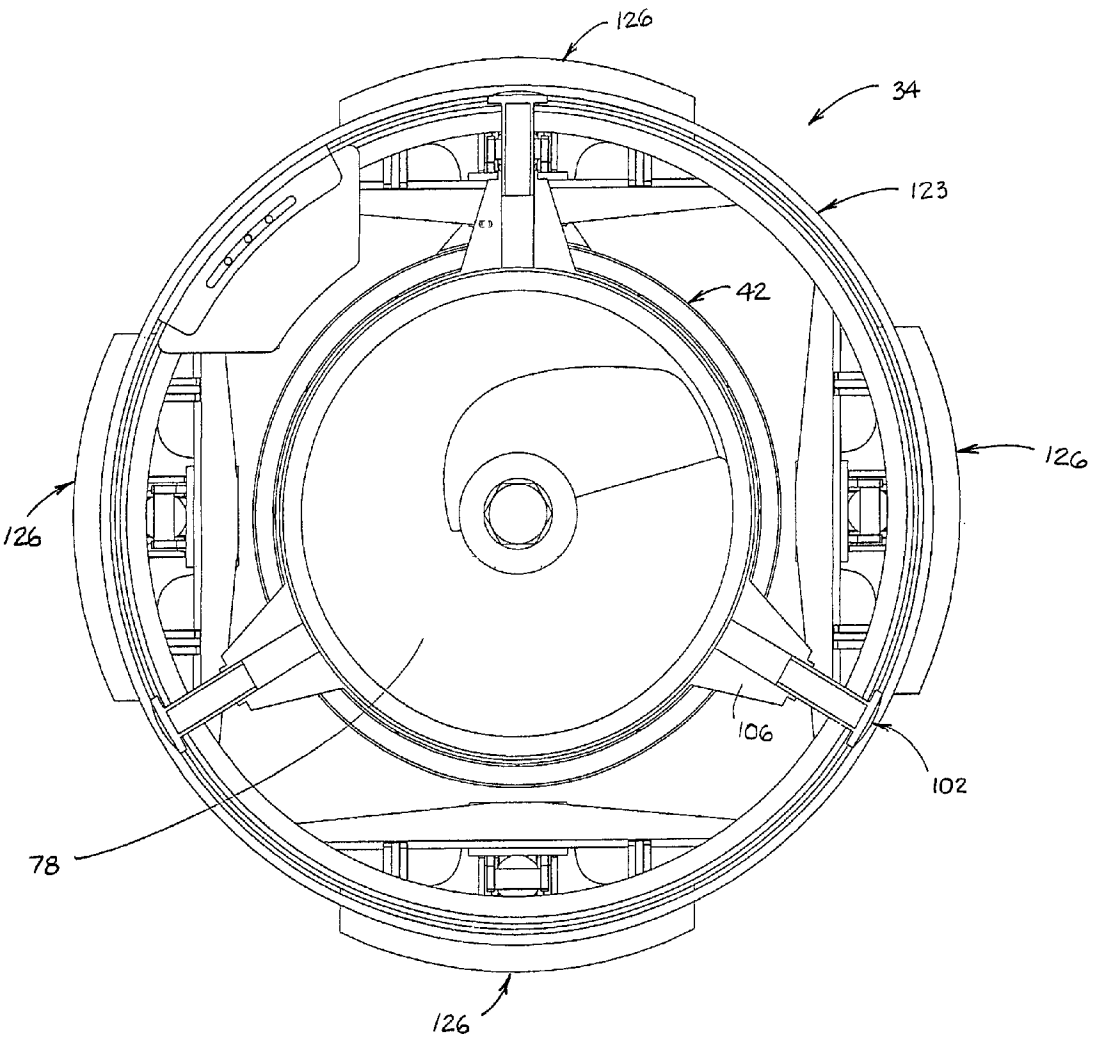
FIG. 12 is a front view of a portion of the boring machine of FIG. 1, with the cutter head removed.
Figure 13:
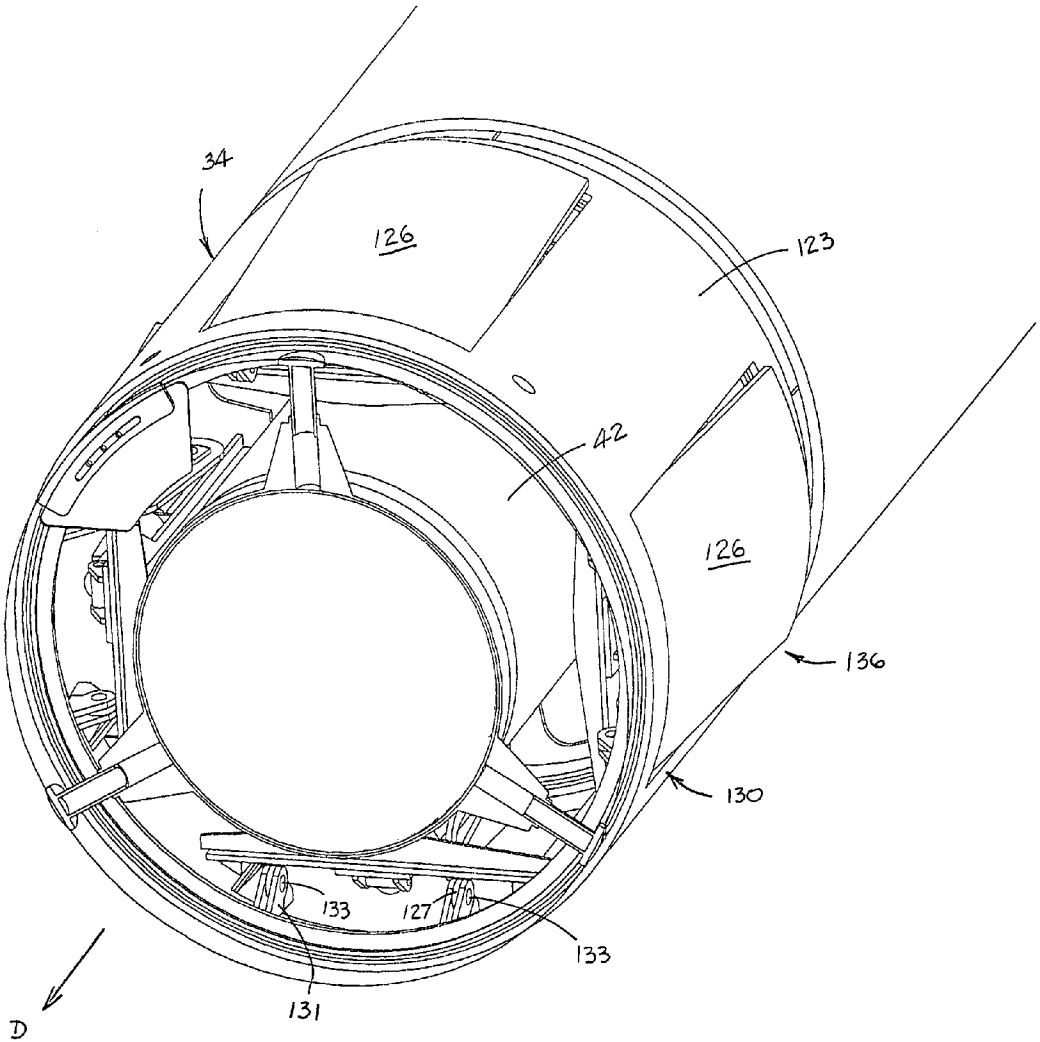
FIG. 13 is a partial perspective view of a portion of the boring machine of FIG. 12 showing the steering head and with the auger removed.
Figure 14:
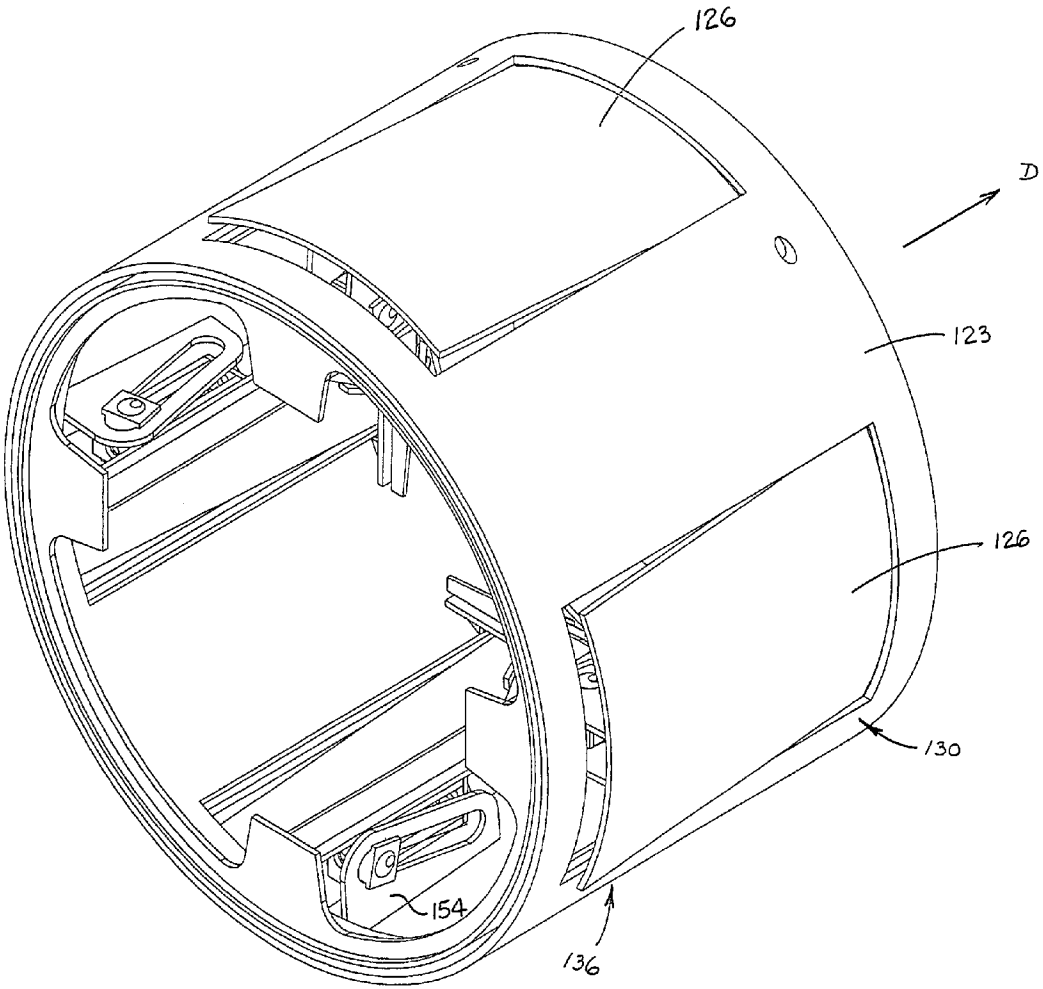
FIG. 14 is a partial perspective rear view of the steering head of FIG. 13, with the internal casing removed.
Figure 15:
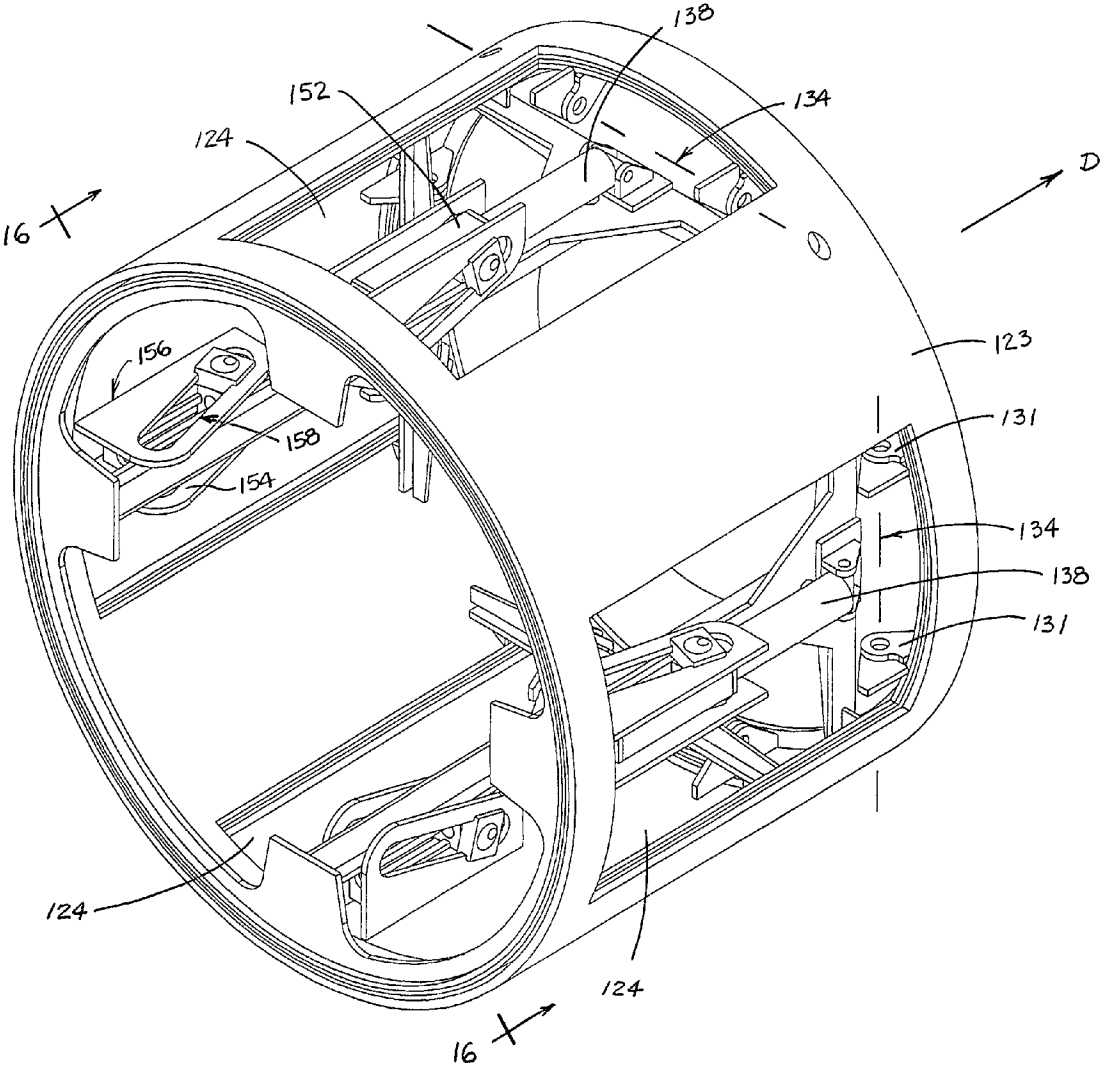
FIG. 15 is a view of the steering head of FIG. 14 with the steering paddles removed for clarity.
Figure 16:
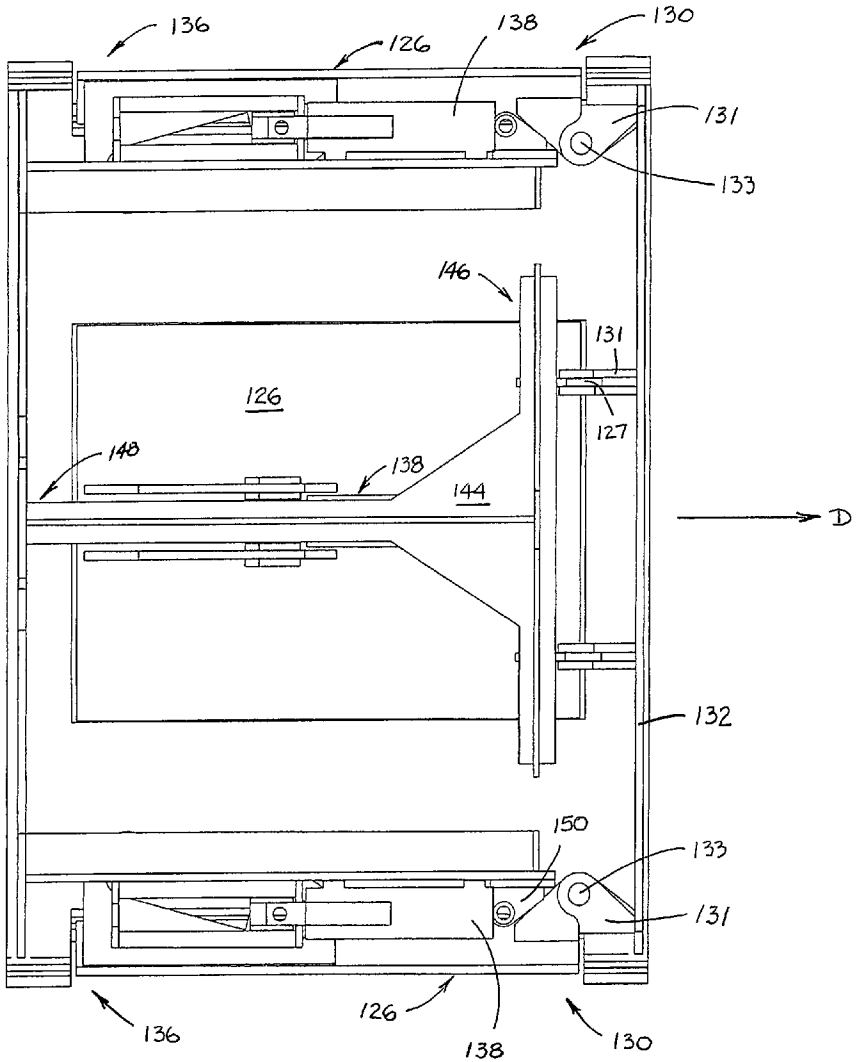
FIG. 16 is a sectional view of the steering head of FIG. 15, taken along the line 16-16 of FIG. 15, but with the guides removed from the steering assembly.
Figure 17:
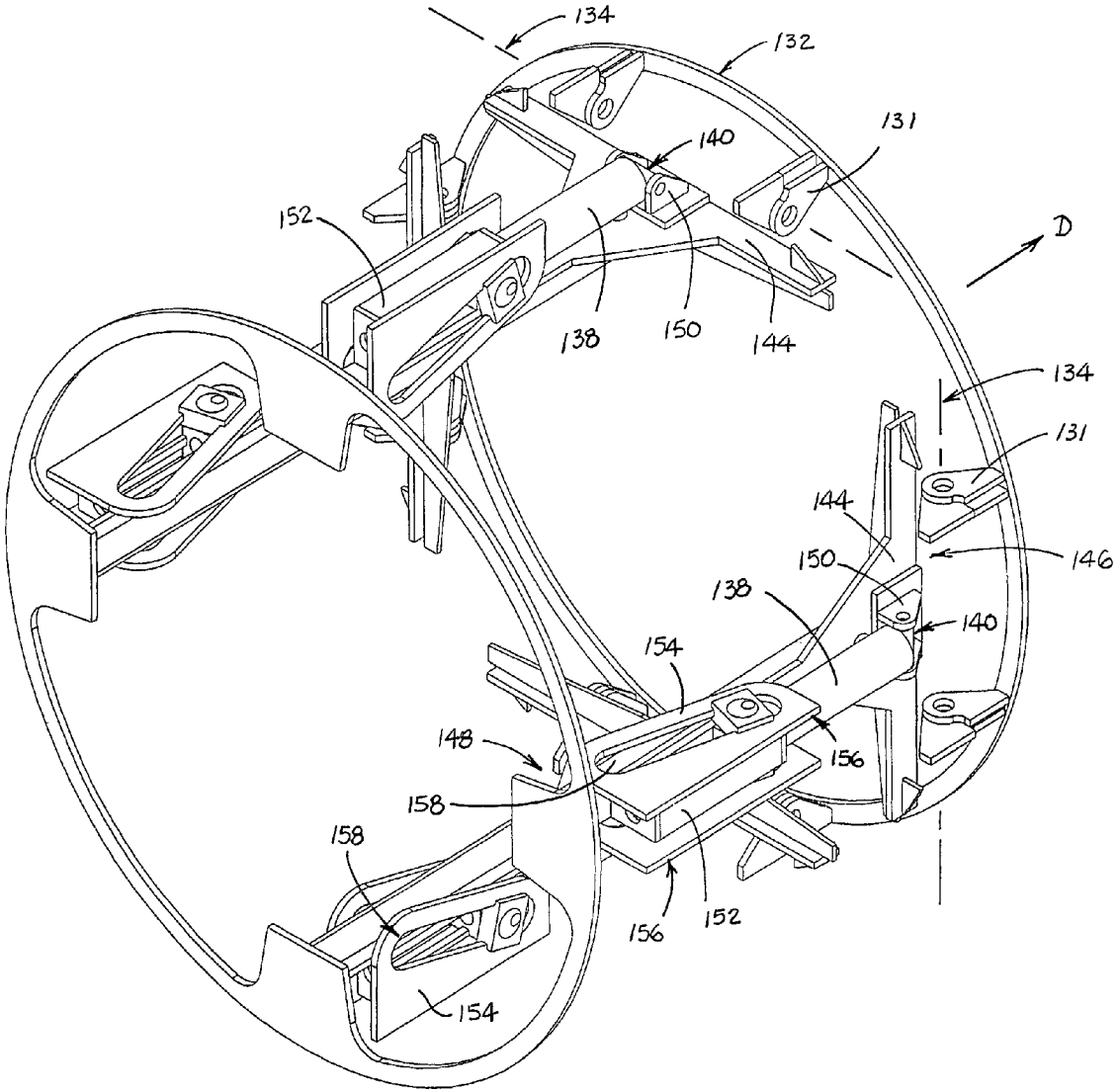
FIG. 17 is a view of the steering head of FIG. 15 with the steering casing and steering paddles removed.
Figure 18:
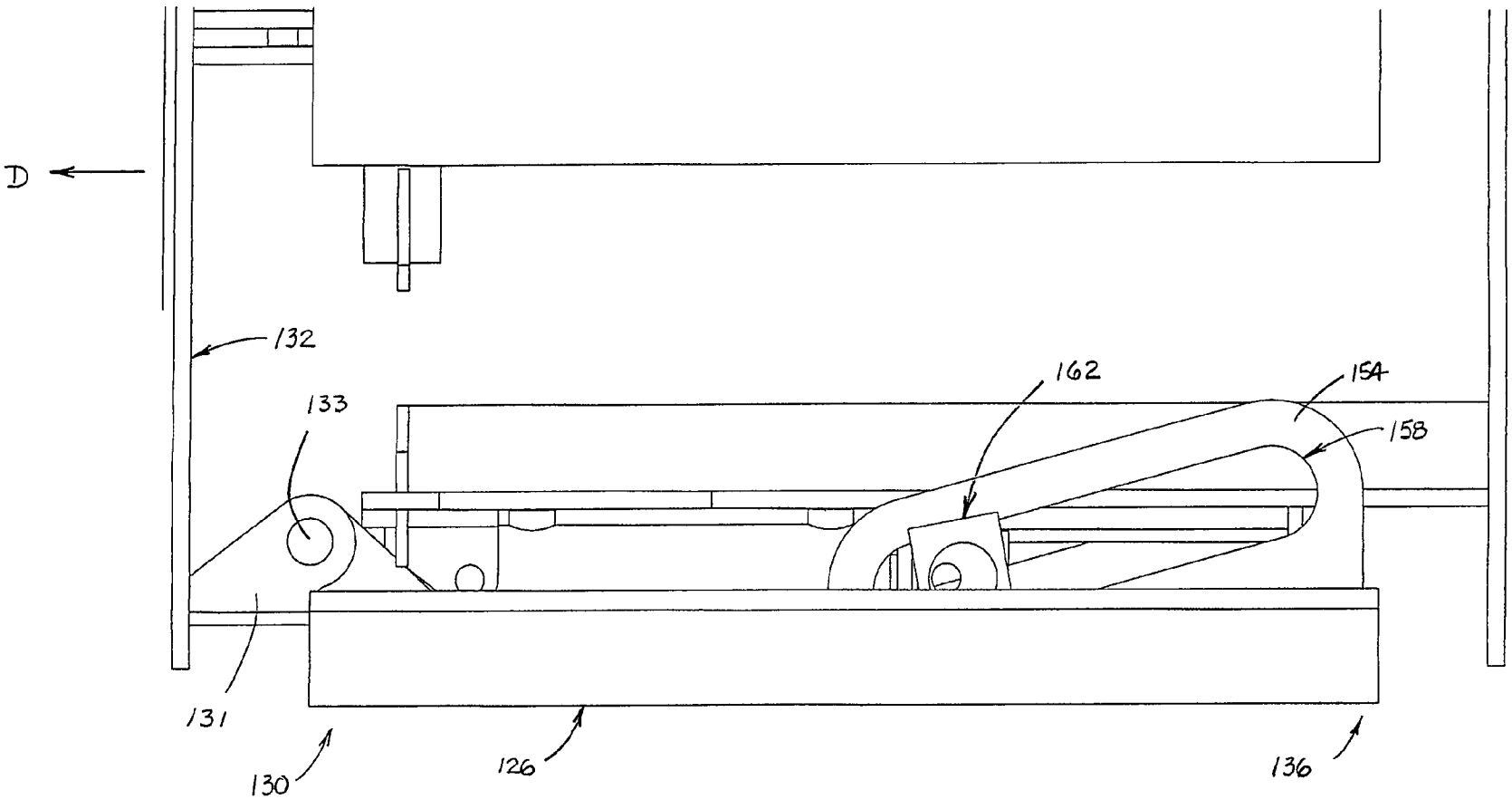
FIG. 18 is a side view of a portion of a preferred steering assembly showing the actuating cylinder in the retracted position.
Figure 19:
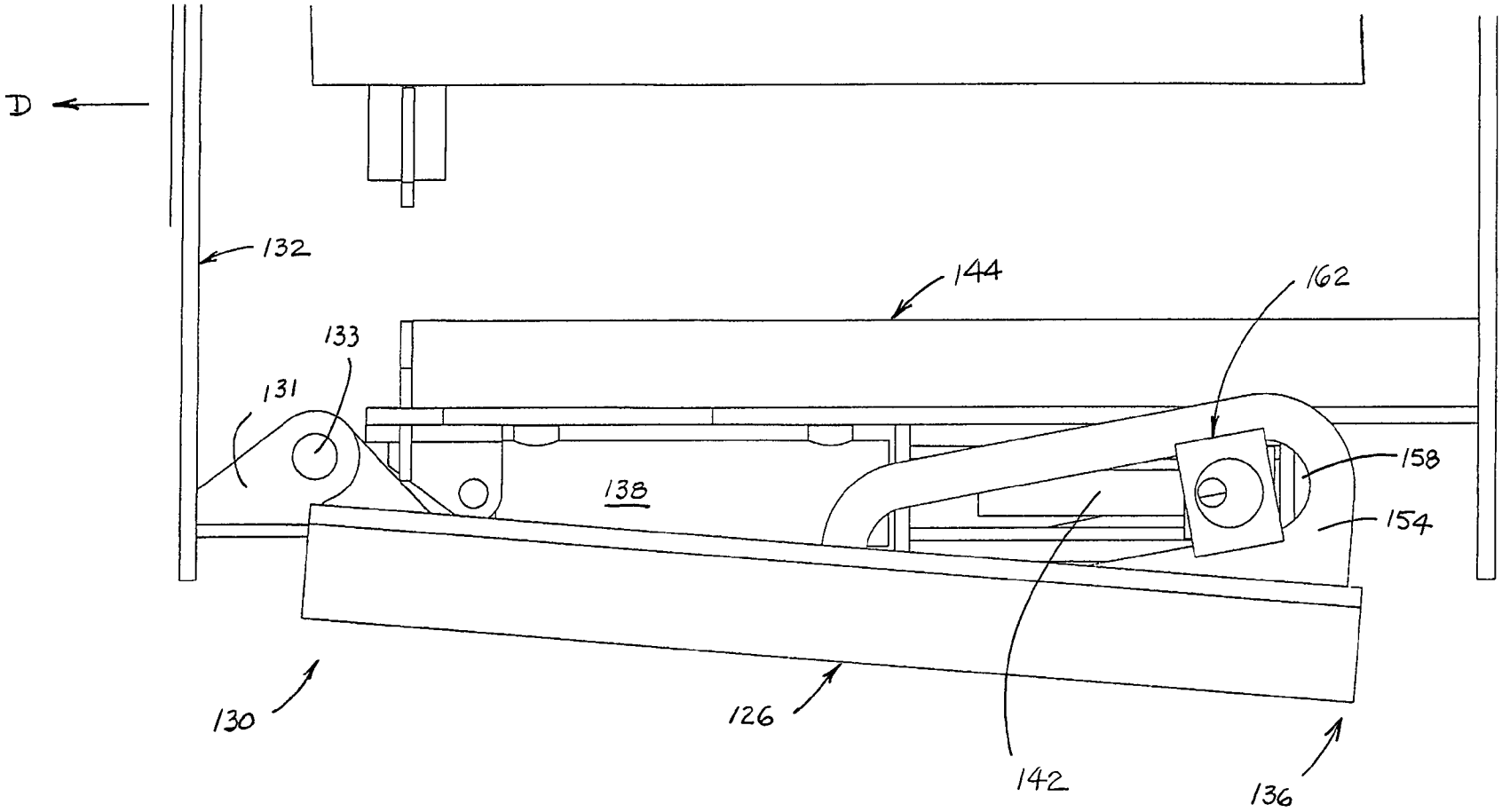
FIG. 19 is a side view of a portion of a preferred steering assembly showing the actuating cylinder in the extended position.
Figure 20:
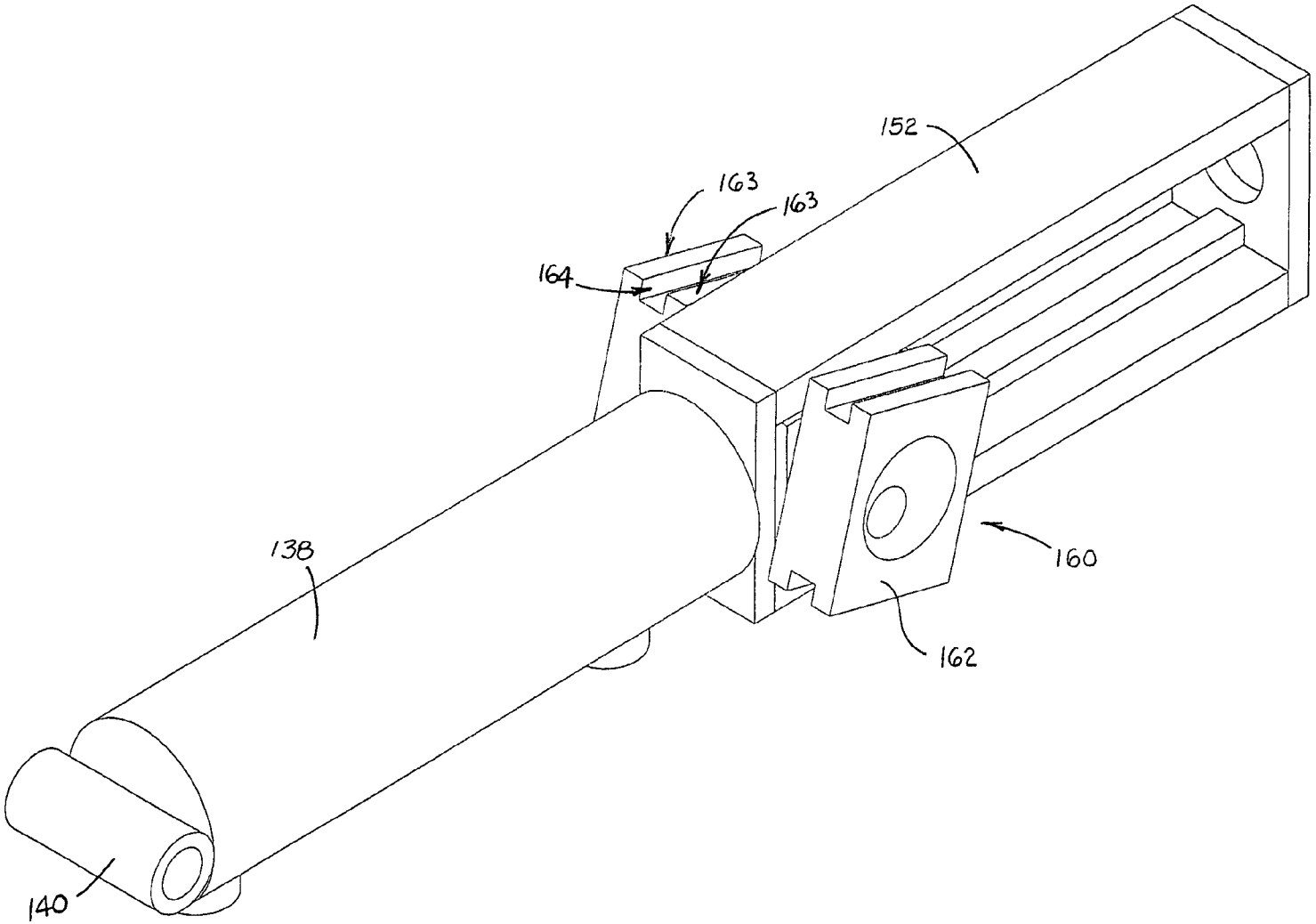
FIG. 20 is a perspective view of a portion of the actuating cylinder and a portion of the force multiplier components of a preferred embodiment of the invention.

FIGS. 12-20 illustrate the details of the preferred steering assembly of boring machine 21. As shown therein, steering head 34 is adapted to be located behind a selected one of the cutter heads, such as cutter head 30. The steering head is adapted to receive the front end of internal casing 42, as shown in FIGS. 12 and 13. Furthermore, the steering head has a steering head longitudinal axis that is coincident with the internal casing longitudinal axis and with longitudinal axis A (see FIG. 3) of the selected product casing. Steering head 34 includes housing 123 with a plurality of steering openings spaced around its periphery. As shown in FIG. 15, housing 123 of steering head 34 has four steering openings 124 spaced at 90° intervals around its periphery. A plurality of steering components are provided, each of which is mounted within the steering head adjacent to a steering opening. Each steering component includes a steering paddle 126 that includes a pair of paddle brackets 127 at its front end 130. The paddle brackets cooperate with a pair of pivot brackets 131 that are mounted to housing 123 and support ring 132 (see FIGS. 16 and 17) located in the front end of steering head 34, and with a pair of pivot pins 133 (see FIGS. 13 and 16), so that the steering paddle can pivot about its paddle pivot axis 134 (two of which are shown in FIGS. 15 and 17), thereby moving rear end 136 of steering paddle 126 out of or into steering opening 124.

The preferred steering assembly of boring machine 21 includes linear actuator 138 that may be operated to direct an actuating force along a line that is parallel to the steering head longitudinal axis, and a force multiplier. The arrangement and configuration of the force multiplier with respect to steering paddle 126 and linear actuator 138 causes the actuating force to be multiplied by a multiplier factor that is greater than one to produce a pivot force that is greater than the actuating force. Preferably, the multiplier factor is within the range of 1.5 to 5.

The pivot force causes the steering paddle to pivot about pivot axis 134. By pivoting the steering paddle about paddle pivot axis 134, rear end 136 of steering paddle 126 can be moved through steering opening 124 to bear against the walls of the bore, causing a reaction force that will change the direction of boring of machine 21. Of course, two or more steering components may be operated at the same time to change the direction of the boring machine.

Linear actuator 138 preferably comprises a hydraulic actuator that includes base 140 and rod 142 (see FIG. 19) which is adapted to extend and retract with respect to the base along a line that is parallel to the steering head longitudinal axis. An attachment frame 144 is provided for each of the preferred steering assemblies, which attachment frame has a front end 146 and a rear end 148. The attachment frame is fixed with respect to steering head 34 and steering paddle 126 adjacent to steering opening 124. Base 140 of linear actuator 138 is mounted to cylinder mounting bracket 150 on the front end 146 of attachment frame 144. Rod end support 152 (best shown in FIG. 20) is attached to the rear end 148 of the attachment frame and adapted to receive the rod end of the hydraulic actuator. The rod end support provides support for the end of rod 142 as it is extended and retracted, and it insures that the path followed by the rod end will be parallel to the steering head longitudinal axis.

In the embodiment of the invention illustrated in the drawings, a pair of guides 154, each of which includes mounting base 156, are attached to the rear end 136 of steering paddle 126. Each guide has a guide slot 158 that is oriented at an acute angle with respect to the steering head longitudinal axis and the mounting base. The angle of the guide slot comprises a multiplier angle for the force multiplier. The cotangent of the multiplier angle equals the multiplier factor, and the product of the multiplier factor and the actuating force supplied by the linear actuator comprises the pivot force. Preferably, the multiplier angle, the angle of the guide slot with respect to the mounting base, is less than 45°. More preferably, the multiplier angle is within the range of 10° to 35°.

Attached to the end of rod 142 is guide block assembly 160, which includes a pair of guide blocks 162, each of which is adapted to be received in guide slot 158 of a guide 154. Each guide block includes a pair of guide slot retainers 163 forming retaining groove 164 which cooperates with the guide slot of a guide 154 in such a manner that extension of the rod end of the actuating cylinder will cause the guide block to move along the guide slot. Since the guide slot is oriented at an acute multiplier angle with respect to the mounting base and the steering head longitudinal axis, extension of rod 142, from its retracted position shown in FIG. 18 to its extended position shown in FIG. 19, causes the guide blocks to travel along guide slot 158, thereby causing steering paddle 126 to pivot so that its rear end 136 moves through the steering opening.

To begin the boring of a tunnel in a desired boring direction and the simultaneous installation of a selected product casing, a launch pit and a target pit are excavated. Track 28 is placed in the launch pit and oriented in the desired boring direction D towards the target pit. Carriage 26 is then mounted on the track in the launch pit. A product casing is selected from the differently-sized product casings that may be installed using the boring machine, and a cutter head is selected so as to have a cutter head diameter which corresponds to the product casing outside diameter of the selected product casing. The selected product casing is installed over the internal casing and the adjustable support assembly is adjusted to maintain the coincidence of the internal casing longitudinal axis with the product casing longitudinal axis of the selected product casing. The selected cutter head is attached to the front end of the auger, and the pusher mechanism is operated to move the carriage from initial end 165 of track 28 to terminal end 166, thereby advancing the selected cutter head, the selected product casing, the auger and the internal casing in the desired boring direction, while the rotational mechanism is simultaneously operated to rotate the auger and the cutter blades. As the cutter blades are rotated and the cutter head is driven by the pusher mechanism in the boring direction, the steering assemblies may be operated to cause a steering paddle 126 to pivot so that its rear end 136 moves through the steering opening, thereby bearing against the walls of the bore, causing a reaction force that will change the direction of boring of machine 21. When the carriage reaches terminal end 166 of the track, the rotational mechanism and the pusher mechanism are stopped, and the selected product casing, the auger and the internal casing are disengaged from the carriage. The carriage is then retracted from the terminal end of the track to the initial end of the track, leaving the selected product casing, internal casing and auger in the bore. An additional adjustable support assembly is mounted to an additional section of internal casing, an additional section of auger is placed within the additional section of internal casing, and an additional section of the selected product casing is placed over the internal casing and auger, so that the additional adjustable support assembly maintains the coincidence of the internal casing longitudinal axis with the product casing longitudinal axis. The additional sections of product casing, internal casing and auger are placed on the track in front of the carriage, and the front ends of the additional section of the selected product casing, the additional section of the internal casing and the additional section of the auger are attached to the rear ends of the casing and conveyor sections that were disengaged from the carriage. The rear end of the additional section of the auger is attached to the rotational mechanism, and the rear ends of the additional section of the selected product casing, the additional section of the internal casing and the additional section of the auger are attached to or engaged by the pusher mechanism. The carriage is then moved by operation of the pusher mechanism to advance the selected cutter head, the selected product casing, the auger and the internal casing from the initial end of the track to the terminal end while operating the rotational mechanism to rotate the auger and the cutter head. These steps are then repeated until the selected product casing reaches the target pit.

When the product casing reaches the target pit, the cutter head is removed from the assembly and the steering head is detached from the first product casing section. The internal casing and auger sections may then be removed, leaving the product casings in the bore. In one method of operating the invention, the carriage is employed to pull the internal casing and auger sections backwardly to the launch pit, where they are removed, one by one. In another method of operation, an alternative driving mechanism is placed in the target pit and employed to pull the internal casing and auger sections forwardly out of the product casing into the target pit.

Although this description contains many specifics, these should not be construed as limiting the scope of the invention, but as merely providing illustrations of some of the presently preferred embodiments thereof, as well as the best mode contemplated by the inventors of carrying out the invention. The invention, as described herein, is susceptible to various modifications and adaptations, as would be understood by those having ordinary skill in the art to which the invention relates, and the same are intended to be comprehended within the meaning and range of equivalents of the appended claims.

What is claimed is:

1. A boring machine for boring a tunnel from a launch pit to a target pit along a desired boring direction and simultaneously installing a selected one of a plurality of differently-sized product casings in the tunnel, in which each product casing of a selected size has a product casing longitudinal axis, a product casing outside diameter, a product casing inside diameter and a product casing inside surface, wherein the boring machine comprises:

(a) an internal casing:
- (i) having an internal casing front end;
- (ii) having an internal casing longitudinal axis;
- (iii) having an internal casing outside surface;
- (iv) having an internal casing outside diameter which is less than all of the product casing inside diameters of the differently-sized product casings that may be installed using the boring machine;
- (v) which is adapted to be placed within a selected one of the product casings with its internal casing longitudinal axis coincident with the longitudinal axis of the selected product casing, thereby forming an annular space with respect to the selected product casing;

(b) an adjustable support assembly that is adapted to be located between the outside surface of the internal casing and the inside surface of the selected product casing for maintaining the coincidence of the internal casing longitudinal axis with the product casing longitudinal axis;

(c) an auger which:
- (i) has a front end;
- (ii) has a rear end;
- (iii) is located within the internal casing and adapted to rotate with respect thereto;
- (iv) is adapted to convey material towards its rear end as it is rotated;

(d) a rotational mechanism which is operationally connected to the auger;

(e) a pusher mechanism which is adapted to advance the selected product casing, the internal casing and the auger;

(f) a plurality of interchangeable cutter heads, each of which:
- has a plurality of cutter blades that are adapted to be attached to the front end of the auger so that operation of the rotational mechanism will cause the auger and the cutter blades to rotate;
- (ii) has a cutter head diameter which corresponds to the product casing outside diameter of the selected product casing;

(g) a plurality of interchangeable steering heads, each of which:
- (i) is adapted to be located behind a selected one of the cutter heads;
- (ii) is adapted to receive the front end of the internal casing;
- (iii) has a steering head longitudinal axis that is coincident with the internal casing longitudinal axis;
- (iv) has a plurality of steering openings spaced around its periphery;

(h) a plurality of steering components, each of which is mounted within the steering head adjacent to a steering opening, wherein each such steering component comprises:

(i) a steering paddle having a front end and a rear end, said front end being pivotally mounted with respect to the steering head so as to pivot about a paddle pivot axis;

(ii) a linear actuator that operates to direct an actuating force along a line that is parallel to the steering head longitudinal axis;

(iii) a force multiplier that is arranged and configured with respect to the steering paddle and the linear actuator so that upon operation of the linear actuator, a pivot force causes the steering paddle to pivot about the pivot axis, said pivot force being the product of the actuating force and a multiplier factor that is greater than one;

wherein operation of the linear actuator to direct an actuating force in a first direction along the line that is parallel to the steering head longitudinal axis will cause the rear end of the steering paddle to move out of the steering opening, and operation of the linear actuator to direct an actuating force in a second direction along the line will cause the rear end of the steering paddle to move into the steering opening.

2. The boring machine of claim 1 wherein the steering head has four steering openings spaced at 90° intervals around its periphery.

3. The boring machine of claim 1 wherein the multiplier factor is within the range of 1.5 to 5.

4. The boring machine of claim 1 wherein, for each steering component:

(a) the force multiplier includes a multiplier angle;

(b) the multiplier factor is equal to the cotangent of the multiplier angle.

5. The boring machine of claim 1 wherein, for each steering component:

(a) the linear actuator comprises a hydraulic actuator which includes:

a cylinder having a base;

(ii) a rod that is adapted to extend and retract with respect to the base along a line that is parallel to the steering head longitudinal axis;

(b) the hydraulic actuator is attached to the force multiplier in such a way that:

(i) extension of the rod of the hydraulic actuator from its retracted position causes the steering paddle to pivot so that the rear end moves out of the steering opening; and (ii) retraction of the rod of the hydraulic actuator from its extended position causes the steering paddle to pivot so that the rear end moves into the steering opening.

6. The boring machine of claim 5 wherein the force multiplier of each steering component comprises:

(a) an attachment frame that is located adjacent to the steering opening and is fixed with respect to the steering head, said attachment frame having a front end and a rear end;

(b) a guide that is mounted to the rear end of the steering paddle, said guide having a mounting base and a guide slot that is oriented at an acute angle with respect to the steering head longitudinal axis;

(c) a cylinder mounting bracket that is attached to the front end of the attachment frame and adapted to receive the base of the hydraulic actuator;

(d) a rod end support that is attached to the rear end of the attachment frame and adapted to receive the rod end of the hydraulic actuator;

(e) a guide block assembly that is attached to the rod end of the hydraulic actuator and supported by the rod end support, said guide block assembly including a guide block that is adapted to be received in the guide slot of the guide, so that extension of the rod end of the hydraulic actuator will cause the guide block to move along the guide slot.

7. The boring machine of claim 6 wherein the guide has a mounting base that is parallel to the steering head longitudinal axis and a guide slot that is oriented at an acute angle with respect to the mounting base.

8. The boring machine of claim 7 wherein the guide slot is oriented at an angle of less than 45° with respect to the mounting base.

9. The boring machine of claim 7 wherein the guide slot is oriented at an angle with respect to the mounting base that is within the range of 10° to 35°.

10. The boring machine of claim 1, which includes:

(a) a track;

(b) a carriage that is mounted on the track, which carriage includes the rotational mechanism and the pusher mechanism.

11. The boring machine of claim 1 wherein the internal casing outside diameter is no more than about 60% of the product casing inside diameter of the product casing having the smallest product casing inside diameter that can be installed using the boring machine.

12. The boring machine of claim 1 wherein the adjustable support assembly comprises a plurality of internal casing support legs spaced around the periphery of the internal casing.

13. The boring machine of claim 12 which includes an internal support band:

(a) that is disposed around the periphery of the internal casing;

(b) to which the internal casing support legs are attached;

(c) that includes a plurality of leg supports, each of which is adapted to cooperate with an internal casing support leg.

14. The boring machine of claim 1 wherein the internal casing comprises a plurality of internal casing components that are joined together end to end at a plurality of internal casing joints, wherein each such internal casing joint comprises:

(a) an end flange mounted to adjacent ends of adjacent internal casing components;

(b) a clamp that is adapted to engage the end flanges of adjacent internal casing components.

15. The boring machine of claim 14 wherein each clamp comprises:

(a) a band that is adapted to encircle and engage the end flanges of adjacent internal casing components, said band including:

(i) a pair of flange engagement sides;

(ii) a first end having a pair of spaced eyes, each of which includes a hole;

(iii) a second end having an engagement bracket which includes an engagement slot;

(b) a bolt comprising:

(i) a T-shaped head that is adapted to be received in the holes in the spaced eyes at the first end of the band;

(ii) a threaded end that extends into the engagement slot of the engagement bracket;

(c) a nut that is adapted to engage the threaded end of the bolt and be retained within the engagement bracket.

16. A boring machine comprising:

(a) a track;

(b) a carriage that is mounted on the track, said carriage comprising:

(i) a pusher mechanism that is adapted to move the carriage along the track;
(ii) a rotational mechanism;

(c) an internal casing that is located in front of the carriage and adapted to be moved by the carriage as the pusher mechanism moves the carriage along the track;

(d) an auger which:
(i) has a front end;
(ii) has a rear end;
(iii) has an auger longitudinal axis;
(iv) is located within the internal casing;
(v) is adapted to rotate with respect to the internal casing;
(vi) is operationally connected to the rotational mechanism of the carriage;
(v) is adapted to convey material towards its rear end as it is rotated;

(e) a cutter head having a plurality of cutter blades which are attached to the front end of the auger so as to rotate therewith;

(f) a steering head which:
(i) is adapted to be located behind the cutter head and in front of the internal casing;
(ii) has a steering head longitudinal axis that is coincident with the auger longitudinal axis;
(iii) has a plurality of steering openings spaced around its periphery;

(g) a plurality of steering components, each of which is mounted within the steering head adjacent to a steering opening, wherein each such steering component comprises:
a steering paddle having a front end and a rear end, said front end being pivotally mounted with respect to the steering head so as to pivot about a paddle pivot axis;
(ii) a linear actuator that operates to direct an actuating force along a line that is parallel to the steering head longitudinal axis;
(iii) a force multiplier that is arranged and configured with respect to the steering paddle and the linear actuator so that upon operation of the linear actuator, a pivot force causes the steering paddle to pivot about the pivot axis, said pivot force being the product of the actuating force and a multiplier factor that is greater than one;

wherein operation of the linear actuator to direct an actuating force in a first direction along the line that is parallel to the steering head longitudinal axis will cause the rear end of the steering paddle to move out of the steering opening, and operation of the linear actuator to direct an actuating force in a second direction along the line will cause the rear end of the steering paddle to move into the steering opening.

17. The boring machine of claim 16 wherein, for each steering component:

(a) the linear actuator comprises a hydraulic actuator which includes:
(i) a cylinder having a base;
(ii) a rod that is adapted to extend and retract with respect to the base along a line that is parallel to the steering head longitudinal axis;

(b) the hydraulic actuator is attached to the force multiplier in such a way that
(i) extension of the rod of the hydraulic actuator from its retracted position causes the steering paddle to pivot so that the rear end moves out of the steering opening; and
(ii) retraction of the rod of the hydraulic actuator from its extended position causes the steering paddle to pivot so that the rear end moves into the steering opening.

18. The boring machine of claim 17 wherein the force multiplier of each steering component comprises:

(a) an attachment frame that is located adjacent to the steering opening and is fixed with respect to the steering head, said attachment frame having a front end and a rear end;

(b) a guide that is mounted to the rear end of the steering paddle, said guide having a mounting base and a guide slot that is oriented at an acute angle with respect to the steering head longitudinal axis;

(c) a cylinder mounting bracket that is mounted to the front end of the attachment frame and adapted to receive the base of the hydraulic actuator;

(d) a rod end support that is attached to the rear end of the attachment frame and adapted to receive the rod end of the hydraulic actuator;

(e) a guide block assembly that is attached to the rod end of the hydraulic actuator and supported by the rod end support, said guide block assembly including a guide block having a retaining groove that is adapted to cooperate with the guide slot of the guide, so that extension of the rod end of the hydraulic actuator will cause the guide block to move along the guide slot.

19. A method for boring a tunnel from a launch pit to a target pit along a desired boring direction and simultaneously installing a selected one of a plurality of differently-sized product casings in the tunnel, in which each product casing of a selected size has a product casing longitudinal axis, a product casing outside diameter, a product casing inside diameter and a product casing inside surface, wherein the method comprises:

(a) providing a boring machine comprising:
(i) an internal casing:
(1) having an internal casing longitudinal axis;
(2) having an internal casing outside surface;
(3) having an internal casing outside diameter which is less than all of the product casing inside diameters of the differently-sized product casings that may be installed using the boring machine;
(4) which is adapted to be placed within a selected one of the product casings with its internal casing longitudinal axis coincident with the longitudinal axis of the selected product casing, thereby forming an annular space with respect to the selected product casing;
(ii) an adjustable support assembly that is adapted to be located between the outside surface of the internal casing and the inside surface of the selected product casing for maintaining the coincidence of the internal casing longitudinal axis with the product casing longitudinal axis;
(iii) an auger which:
(1) has a front end;
(2) has a rear end;
(3) is located within the internal casing and adapted to rotate with respect thereto;
(4) is adapted to convey material towards its rear end as it is rotated;
(iv) a track having:
(1) an initial end;
(2) a terminal end;
(v) a carriage that is adapted to be mounted on the track and moved therealong, which carriage includes:

(1) a rotational mechanism which is operationally connected to the auger;

(2) a pusher mechanism which is adapted to move the carriage along the track to advance the selected product casing, the internal casing and the auger;

(vi) a plurality of interchangeable cutter heads, each of which:

(1) has a plurality of cutter blades which are adapted to be attached to the front end of the auger;

(2) has a cutter head diameter which corresponds to the product casing outside diameter of one of the differently-sized product casings;

(vii) a plurality of interchangeable steering heads, each of which:

(1) is adapted to be located behind a selected one of the cutter heads;

(2) is adapted to receive the front end of the internal casing;

(3) has a steering head longitudinal axis that is coincident with the internal casing longitudinal axis;

(4) has a plurality of steering openings spaced around its periphery;

(viii) a plurality of steering components, each of which is mounted within the steering head adjacent to a steering opening, wherein each such steering component comprises:

(1) a steering paddle having a front end and a rear end, said front end being pivotally mounted with respect to the steering head so as to pivot about a paddle pivot axis;

(2) a linear actuator that operates to direct an actuating force along a line that is parallel to the steering head longitudinal axis;

(3) a force multiplier that is arranged and configured with respect to the steering paddle and the linear actuator so that upon operation of the linear actuator, a pivot force causes the steering paddle to pivot about the pivot axis, said pivot force being the product of the actuating force and a multiplier factor that is greater than one;

wherein operation of the linear actuator to direct an actuating force in a first direction along the line that is parallel to the steering head longitudinal axis will cause the rear end of the steering paddle to move out of the steering opening, and operation of the linear actuator to direct an actuating force in a second direction along the line will cause the rear end of the steering paddle to move into the steering opening;

(ix) which includes means for directing material cut by the cutter blades into the internal casing so that rotation of the auger will convey such material towards the rear end of the auger within the internal casing;

(b) excavating a launch pit;

(c) excavating a target pit;

(d) placing the track in the launch pit and orienting it in the desired boring direction towards the target pit;

(e) mounting the carriage on the track in the launch pit;

(f) selecting a product casing from the differently-sized product casings that may be installed using the boring machine;

(g) selecting a cutter head having a cutter head diameter which corresponds to the product casing outside diameter of the selected product casing;

(h) installing the selected product casing over the internal casing;

(i) adjusting the adjustable support assembly to maintain the coincidence of the internal casing longitudinal axis with the product casing longitudinal axis of the selected product casing;

(j) attaching the selected cutter head to the front end of the auger;

(k) operating the rotational mechanism to rotate the auger and the cutter blades while operating the pusher mechanism to advance the selected cutter head, the selected product casing, the auger and the internal casing.

20. The method of claim 19 which includes:

(a) operating the pusher mechanism to move the carriage from the initial end of the track to the terminal end of the track, thereby advancing the selected cutter head, the selected product casing, the auger and the internal casing in the desired boring direction, while operating the rotational mechanism to rotate the auger and the cutter blades;

(b) stopping the operation of the rotational mechanism and the pusher mechanism;

(c) disengaging the selected product casing, the auger and the internal casing from the carriage;

(d) retracting the carriage from the terminal end of the track to the initial end of the track;

(e) providing an additional section of internal casing having a front end and a rear end;

(f) mounting an additional adjustable support assembly to the additional section of internal casing;

(g) providing an additional section of auger having a front end and a rear end;

(h) placing the additional section of auger within the additional section of internal casing with the front end of the additional section of auger adjacent to the front end of the additional section of internal casing;

(i) providing an additional section of the selected product casing having a front end and a rear end;

(j) placing the additional section of the selected product casing over the internal casing and auger with the front end of the additional section of the selected product casing adjacent to the front ends of the internal casing and auger, so that the additional adjustable support assembly maintains the coincidence of the internal casing longitudinal axis with the product casing longitudinal axis;

(k) placing the additional sections of product casing, internal casing and auger onto the track in front of the carriage;

(l) attaching the front ends of the additional section of the selected product casing, the additional section of the internal casing and the additional section of the auger to the casing and conveyor sections that were disengaged from the carriage;

(m) attaching the rear end of the additional section of the auger to the rotational mechanism;

(n) attaching the rear ends of the additional section of the selected product casing, the additional section of the internal casing and the additional section of the auger to the pusher mechanism;

(o) moving the carriage from the initial end of the track to the terminal end of the track while operating the rotational mechanism to rotate the auger and the cutter head, and while operating the pusher mechanism to advance the selected cutter head, the selected product casing, the auger and the internal casing;

(p) repeating steps (b) through (o) until the selected product casing reaches the target pit.

* * * * *